US006338390B1

(12) United States Patent
Tibbitts

(10) Patent No.: US 6,338,390 B1
(45) Date of Patent: Jan. 15, 2002

(54) METHOD AND APPARATUS FOR DRILLING A SUBTERRANEAN FORMATION EMPLOYING DRILL BIT OSCILLATION

(75) Inventor: Gordon A. Tibbitts, Salt Lake City, UT (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/228,864

(22) Filed: Jan. 12, 1999

(51) Int. Cl.[7] ..... E21B 7/24
(52) U.S. Cl. ..... 175/56; 175/381
(58) Field of Search ..... 175/56, 189, 322, 175/296, 299, 381

(56) References Cited

U.S. PATENT DOCUMENTS

| | | | | |
|---|---|---|---|---|
| 1,758,774 | | 5/1930 | Zublin . | |
| 2,390,646 | | 12/1945 | Hays . | |
| 2,400,853 | * | 5/1946 | Stilley | 175/381 |
| 3,142,345 | | 7/1964 | Hawthorne et al. . | |
| 3,387,673 | | 6/1968 | Thompson . | |
| 3,684,037 | | 8/1972 | Bodine . | |
| 4,261,425 | | 4/1981 | Bodine . | |
| 4,266,619 | | 5/1981 | Bodine . | |
| 4,386,669 | * | 6/1983 | Evans | 175/381 |
| 4,446,935 | | 5/1984 | Schumacher, Jr. . | |
| 4,527,637 | | 7/1985 | Bodine . | |
| 4,615,400 | | 10/1986 | Bodine . | |
| 4,693,325 | | 9/1987 | Bodine . | |
| 4,693,326 | | 9/1987 | Bodine . | |
| 4,775,016 | * | 10/1988 | Barnard | 175/56 |
| 4,815,328 | | 3/1989 | Bodine . | |
| 4,830,122 | | 5/1989 | Walter . | |
| 4,848,486 | | 7/1989 | Bodine . | |
| 4,913,234 | | 4/1990 | Bodine . | |
| 4,958,691 | | 9/1990 | Hipp . | |
| 5,156,223 | | 10/1992 | Hipp . | |
| 5,190,114 | * | 3/1993 | Walter | 175/56 |
| 5,234,056 | | 8/1993 | Bodine et al. . | |
| 5,303,784 | * | 4/1994 | Awdujewski et al. | 175/56 |
| 5,540,295 | * | 7/1996 | Serrette | 175/56 |
| 5,562,169 | | 10/1996 | Barrow . | |
| 5,779,403 | | 7/1998 | Kleine et al. . | |
| 5,836,410 | | 11/1998 | Kleine . | |

* cited by examiner

*Primary Examiner*—William Neuder
(74) *Attorney, Agent, or Firm*—TraskBritt

(57) ABSTRACT

Apparatus and methods for drilling subterranean formations with a rotary-type drill bit are disclosed in which oscillation is produced in the drill string, drill bit or cutting element, in an axial and/or torsional direction, to produce formation chips that have both thin portions and thick portions. More specifically, the oscillations cause a cutting element of the drill bit to engage the formation to various degrees, resulting in a chip that has varying thicknesses which facilitate fracture of the chip along its thinner portions, thereby reducing the likelihood of adherence of the formation chips to the drill bit or cutting element.

32 Claims, 14 Drawing Sheets

METHOD AND APPARATUS FOR DRILLING A SUBTERRANEAN FORMATION EMPLOYING DRILL BIT OSCILLATION

BACKGROUND OF THE INVENTION

1. Field of the Invention

The present invention relates generally to methods of drilling subterranean formations using rotary-type drag bits, and more particularly to such methods employing an oscillating drill bit for more effective removal of formation chips from around the drill bit using drilling fluid.

2. Description of Related Art

Fixed-cutter rotary drag bits have been employed in subterranean drilling for many decades with various sizes, shapes and patterns of natural and synthetic diamonds used on drag bit crowns as cutting elements. Rotary drag-type drill bits typically comprise a bit body having a shank for connection to a drill string and an inner channel for supplying drilling fluid to the face of the bit through nozzles or other apertures. Drag bits may be cast and/or machined from metal, typically steel, or may be formed of a powder metal (typically tungsten carbide (WC)) infiltrated at high temperatures with a liquified binder material (typically copper-based) to form a matrix. Such bits may also be formed with layered-manufacturing technology, as disclosed in U.S. Pat. No. 5,433,280, which is assigned to the assignee of the present invention and incorporated herein by reference.

The bit body typically carries a plurality of cutting elements which is mounted directly on the face of the bit body or on carrier elements. The cutting elements are positioned adjacent fluid courses which allow cuttings (i.e., formation chips) generated during drilling to flow from the cutting elements to and through junk slots on the gage of the bit. The cuttings then move to the borehole annulus above the bit. Cutting elements may be secured to the bit by preliminary bonding to a carrier element, such as a stud, post, or cylinder, which is, in turn, inserted into a pocket, socket, recess or other aperture in the face of the bit and mechanically or metallurgically secured thereto.

One type of drag bit includes polycrystalline diamond compact (PDC) cutters typically comprised of a diamond table (usually of circular, semi-circular or tombstone shape) which presents a generally planar cutting face. A cutting edge (sometimes chamfered or beveled) is formed on one side of the cutting face which, during boring, is at least partially embedded into the formation so that the formation impacts at least a portion of the cutting face. As the bit rotates, the cutting face contacts the formation and a chip of formation material shears off and rides up the surface of the cutting face. When the bit is functioning properly, the chip breaks off from the formation and is transported out of the borehole via circulating drilling fluid. Another chip then begins to form in the vicinity of the cutting edge, slides up the cutting face of the cutting element, and breaks off in a similar fashion. Such action occurring at each cutting element on the bit removes formation material over the entire gage of the bit, and thereby causes the borehole to become progressively deeper.

In some subterranean formations, PDC cutting elements are very effective in cutting the formation as the drag bit rotates and the cutting edge of the cutting element engages the formation. However, in certain formations exhibiting plastic behavior, such as highly pressurized deep shales, mudstones, siltstones, some limestones and other ductile formations, the formation chips have a marked tendency to adhere to the leading surface of the bit body and the cutting face of the cutting element.

When formation chips adhere to the cutting elements, fluid courses or junk slots of the drill bit, the accumulated mass of chips impedes the flow of drilling fluid to the cutters and impedes the flow through the fluid courses and junk slots resulting in the reduction of cooling efficiency of the drilling fluid. Additionally, adherence of formation chips at or near the cutting faces of the cutting elements can actually prevent chips from sliding over the cutting face resulting in reduced cutting efficiency.

When these formation chips adhere to the cutting face of a cutting element, they tend to collect and build up as a mass of cuttings ahead of and adjacent to the point or line of engagement between the cutting face of the PDC cutting element and the formation, potentially increasing the net effective stress of the formation being cut. The buildup of formation chips moves the cutting action away from and ahead of the edge of the PDC cutting element and alters the failure mechanism and location of the cutting phenomenon so that cutting of the formation is actually effected by the built-up mass, which obviously is quite dull. Thus, the efficiency of the cutting elements, and hence of the drag bit itself, is drastically reduced.

Undesired adhesion of formation cuttings to the PDC cutting elements has long been recognized as a problem in the subterranean drilling art. A number of different approaches have been attempted to facilitate removal of formation cuttings from the cutting face of PDC cutting elements. For example, U.S. Pat. No. 5,582,258 to Tibbitts et al., assigned to the assignee of the present invention and herein incorporated by this reference, includes a chip breaker formed adjacent the cutting edge of the cutting elements to impart strain to a formation chip by bending and/or twisting the chip and thereby increasing the likelihood that the chip will break away from the face of the bit. Other approaches to solving the problem of formation chip removal include U.S. Pat. No. 4,606,418 to Thompson which discloses cutting elements having an aperture in the center thereof which feeds drilling fluid from the interior of the drill bit onto the cutting face to cool the diamond table and to remove formation cuttings.

U.S. Pat. No. 4,852,671 to Southland discloses a diamond cutting element which hag a passage extending from the support structure of the cutting element to the extreme outermost portion of the cutting element, which is notched in the area in which it engages the formation being cut so that drilling fluid from a plenum on the interior of the bit can be fed through the support structure and to the edge of the cutting element immediately adjacent the formation. U.S. Pat. No. 4,984,642 to Renard et al. discloses a cutting element having a ridged or grooved cutting face on the diamond table to promote the break-up of formation chips, or in the case of a machine tool, the break-up of chips of material being machined, and enhance their removal from the cutting face. The irregular topography of the cutting face assists in preventing balling or clogging of the drag bit by reducing the effective surface or contact area of the cutting face, which also reduces the pressure differential of the formation chips being cut. U.S. Pat. No. 5,172,778 to Tibbitts et al., assigned to the assignee of the present application, employs ridged, grooved, stair-step, scalloped, waved and other alternative non-planar cutting surface topographies to permit and promote the access of fluid in the borehole to the area on the cutting element cutting face immediately adjacent to and above the point of engagement with the formation. Such a non-planar cutting surface helps to equalize differential pressure across the formation chip being cut and thus reduce the shear force which opposes chip movement across the cutting surface.

U.S. Pat. No. 4,883,132 to Tibbitts, assigned to the assignee of the present application, discloses a novel drill bit design providing large cavities between the face of the bit and the cutting elements engaging the formation. Formation cuttings entering the cavity area are thus unsupported and more likely to break off for transport up the borehole. In addition, clearing of the cut chips is facilitated by nozzles aimed from behind the cutting elements (taken in the direction of bit rotation) so that the chips are impacted in a forward direction to break off immediately after being cut from the formation. U.S. Pat. No. 4,913,244 to Trujillo, assigned to the assignee of the present invention, discloses bits which employ large cutters having associated therewith directed jets of drilling fluid emanating from specifically oriented nozzles placed in the face of the bit in front of the cutting elements. The jet of drilling fluid is oriented so that the jet impacts between the cutting face of the cutting element and a formation chip as it is moving along the cutting face to peel the chip away from the cutting element and toward the gage of the bit. Likewise, GB 2,085,945 to Jurgens provides nozzles that direct drilling fluid toward the cutting elements to flush away cuttings generated by the cutting elements.

U.S. Pat. No. 5,447,208 to Lund et al., assigned to the assignee of the present invention, discloses a superhard cutting element having a polished, low friction, substantially planar cutting face to reduce chip adhesion across the cutting face. U.S. Pat. No. 5,115,873 to Pastusek, assigned to the assignee of the present application, discloses yet another manner in which formation cuttings can be removed from a cutting element by use of a structure adjacent to and/or incorporated with the face of the cutting element to direct drilling fluid to the face of the cutting element and behind the formation chip as it comes off the formation.

It has also been disclosed in the art that drilling systems which employ cycloidal sonic energy as a method of drilling cause highly effective cutting action on the bottom and particularly the adjacent side walls of the bottom portion of the well bore by virtue of the cycloidal drilling action. Typically, such vibratory drilling systems employ orbiting mass oscillators to generate vibratory energy. Such orbiting mass oscillators may employ orbiting rollers which are rotatably driven around the inner race wall of a housing, as disclosed in U.S. Pat. No. 4,815,328 to Bodine, or an unbalanced rotor, the output of which is coupled to a drill bit, as disclosed in U.S. Pat. No. 4,261,425 to Bodine. U.S. Pat. No. 5,562,169 to Barrow discloses a sonically driven drill bit employing an oscillator adapted to transmit sinusoidal pressure waves through the drill pipe.

None of the foregoing approaches to cutting element and bit design have been completely successful in facilitating chip removal from the face of the cutting element. Moreover, it will be appreciated by those skilled in the art that many of the foregoing approaches require significant modification to the cutting elements themselves, to the structure carrying the cutting elements on the bit face, and/or to the bit itself. Thus, many of the foregoing approaches to the problem require significant expenditures which substantially raise the price of the drill bit. In addition, due to required cutter placement on certain styles and sizes of bits, many of the prior art hydraulic chip removal arrangements are unsuitable for general application. Moreover, those bits employing vibrating drilling systems do not address the problem of chip removal. Accordingly, it would be extremely desirable to provide the industry with a solution to the impairment to the cutting mechanism caused by chip adhesion, which solution could be economically employed in any drill bit regardless of size or style, and regardless of the type of formation which might be encountered by the drill bit.

BRIEF SUMMARY OF THE INVENTION

In accordance with the present invention, drilling apparatus is provided for effecting a drilling method in which formation chips are produced with varying thicknesses to promote fracturing of the formation chips, thereby avoiding the buildup of formation chips near the bit body and facilitating removal of the formation chips from the bit face. Formation chips having various thicknesses are produced by selectively modifying the degree to which the cutting elements of the bit contact and cut the formation. Selective modification of the degree to which cutting elements contact the formation is achieved in the present invention by essentially modifying the axial and/or rotational/torsional movement of the drill bit, portions of the drill bit or the cutting elements attached to the drill bit.

The present invention provides apparatus for drilling a subterranean formation employing, by way of example only, a rotary-type drag bit comprising a bit body having a plurality of longitudinally extending blades, where adjacent blades define fluid courses with communicating junk slots therebetween. A plurality of cutting elements is attached to the blades, each cutting element including a cutting face oriented toward a fluid course. Upon rotation of the drill bit in a subterranean formation, formation chips cut by the cutting elements slide across the cutting elements, into the fluid courses and through the junk slots. The formation chips are then flushed into the annulus of the borehole.

In accordance with the drilling methods of the present invention, movement of the drill string, bit body or cutting elements is modified in a manner which introduces weak points into the formation chips as they are cut from the formation. That is, varying thicknesses are introduced into each formation chip as it is cut, thereby facilitating preferential breaking of the chip. In one embodiment, the bit is structured to oscillate torsionally as it rotates to produce alternating, relatively thicker and thinner sections of the chip such that each thicker chip portion is more likely to break away from the rest of the chip along the thinner portions of the chip by the force of drilling fluid contacting the chip. The broken formation chips enable their removal from the bit body and the borehole. Oscillation can be achieved by, for example, vibrating a near-bit sub or the bit shank using, for example, unbalanced rotating masses or an oscillating motor having an unbalanced rotor. In addition, such torsional oscillations may be produced at the surface by using a slip clutch in a near-bit sub, at the top drive, or in association with the rotating table. A pulsing hole wall brake, which cyclically engages and disengages the wall of the well bore, or a near-bit sub having a rotational transmission device which cyclically engages and disengages the drill bit may also oscillate the rotational velocity of the rotating drill bit. In harder formations, a cavitation jet which creates an irregular turbulent flow of drilling fluid around the bit, the flow direction of which oscillates, may cause vibration and, thus, may cause rotational oscillation of the bit relative to the well bore. Finally, a drill bit having individually oscillating cutting elements induced by increasing and decreasing drilling fluid pressure to the cutting elements may be employed to achieve the desired torsional oscillation.

In another embodiment of the invention, the bit is vertically oscillated relative to the longitudinal axis of the bit such that the load on the drill bit is cyclically increased and decreased to effect alternating deeper and relatively more shallow cuts into the formation, thus varying the thickness of formation chips generated by the cutting elements. Such vertical oscillations may be affected by varying the weight on bit (WOB) at the top drive. In addition, vertical oscillations may be accomplished by employing a fluid pulse to cyclically create alternating higher and lower hydrostatic pressures in the bit to cause variable degrees of contact with the formation. This may be accomplished by employing a valve and fluid jet assembly on a near-bit sub to "pulse" the drill bit vertically or at an angle, or by employing a valve and a piston-like assembly in or above the drill bit to cyclically vary the depth of cut (DOC) of the drill bit into the formation. In addition, a drill bit which is resiliently attached to the drill string, such as by a spring-loaded bit sub or piston-like bit sub which can vertically oscillate the bit relative to its longitudinal axis, can cyclically vary the depth of cut of the bit into the bottom of the borehole to produce formation cuttings of different thicknesses. Vertical oscillation in the cutting elements may also be produced by structuring a bit having adjustable blades.

In yet another embodiment of the invention, both vertical and torsional oscillation may be imposed on the drill bit by combining devices that produce vertical oscillation with those that produce torsional oscillation. Likewise, drill bit oscillation that is neither completely torsional nor completely vertical, but at some angle to the longitudinal axis of the drill bit, may be produced by combining devices herein describe or by operating a single device, such as a fluid pulse, at an angle to the longitudinal axis of the drill bit.

BRIEF DESCRIPTION OF THE DRAWINGS

In the drawings, which illustrate what is currently considered to be the best mode for carrying out the invention.

DETAILED DESCRIPTION OF THE INVENTION

Figure 1:
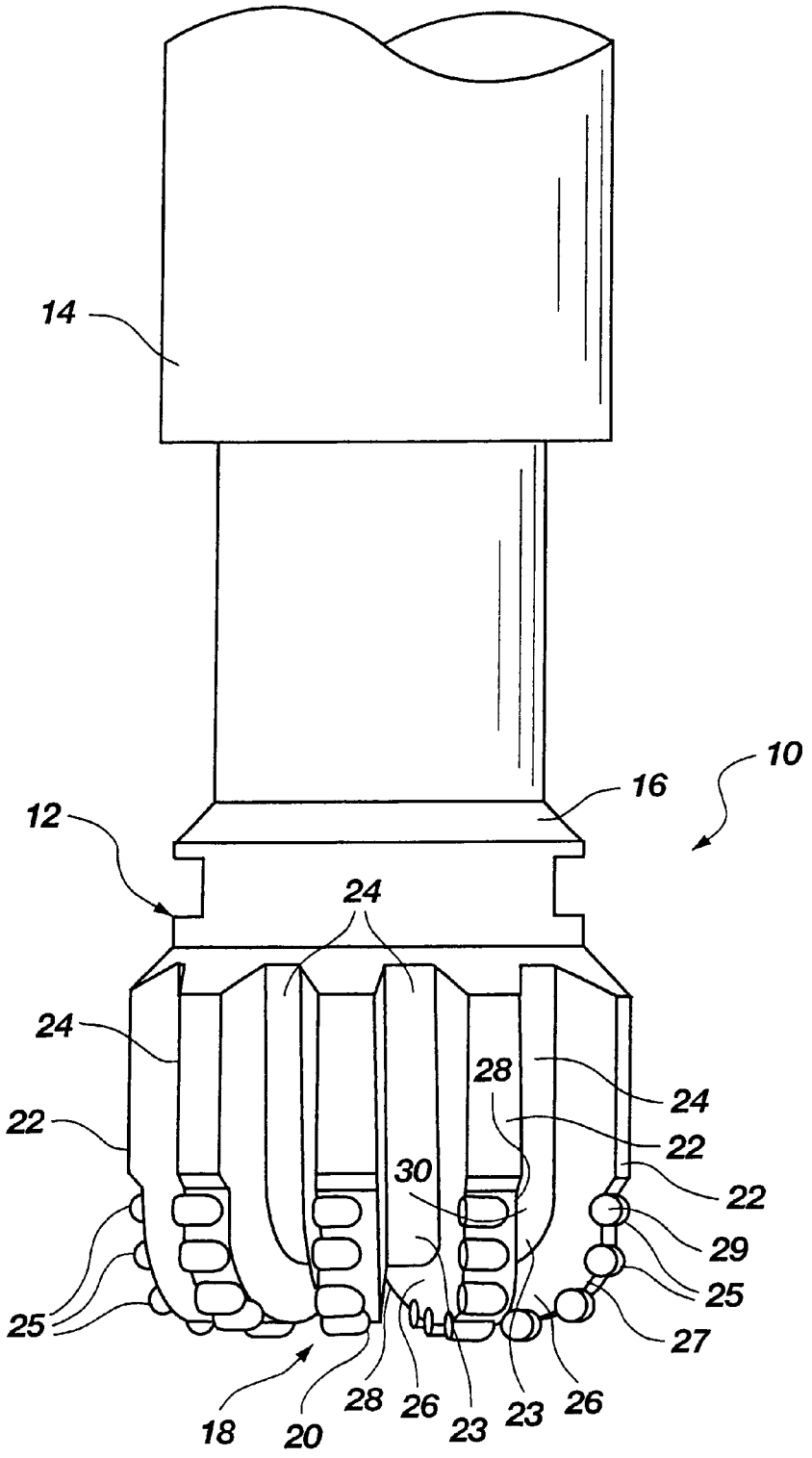
FIG. 1 is a view in elevation of a rotary-type drill bit in accordance with the present invention.

A typical rotary-type drill bit 10, as shown in FIG. 1, comprises a bit body 12, attached at the proximal end 16 thereof to a near-bit sub member 14, and a bit crown 18 located at the distal end 20 of the drill bit 10. The bit crown 18 includes a plurality of longitudinally extending blades 22 with a fluid course 23 positioned between each adjacent pair of blades 22. Each fluid course 23 has a communicating junk slot 24 which is also positioned between adjacent blades 22. Along each blade 22, proximate the distal end 20 of the bit 10, a plurality of cutting elements 25 is attached to the leading edge 27 of each blade 22 and oriented to cut into a subterranean formation upon rotation of the bit 10. Each fluid course 23 is specifically defined by a first side wall 26, a second side wall 28 and a bottom 30. The first side wall 26 provides a surface adjacent the cutting face 29 of each cutting element 25.

In conventional drilling, as formation chips are cut by the cutting elements 25, the chips slide over the cutting face 29 of each cutting element 25, across the side wall 26 adjacent the cutting elements 25 and into the corresponding fluid course 23. In ideal conditions, drilling fluid directed through the fluid course 23 removes the chips from the cutting elements 25 and provides substantially clean cutting faces 29 during drilling. In some situations, such as drilling formations that exhibit plastic characteristics, the formation chips may tend to stick or adhere to the cutting face 29 of the cutting elements 25 and the adjacent side wall 26 of the fluid course 23. Accordingly, drilling fluid flowing through the fluid course 23 may not adequately lift the formation chips from the side wall 26 for flushing away from the bit 10.

Figure 2:
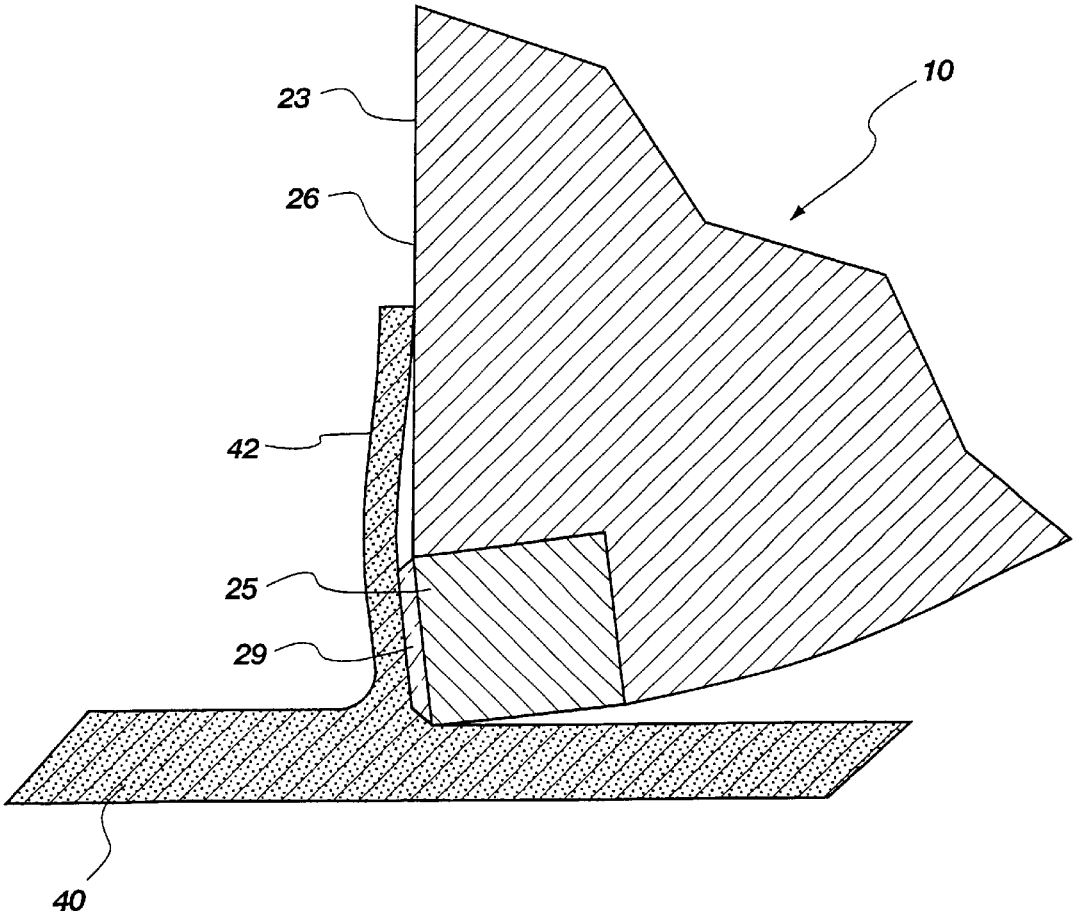
Fig. 2 (PRIOR ART)
FIG. 2 is a partial view in cross-section of a formation chip being cut by a cutting element on a drill bit using a prior art method of drilling.

As illustrated in FIG. 2, a typical method of drilling into a subterranean formation 40 employs both rotation of the bit 10 and weight on bit (WOB) to force the cutting element 25 into the formation 40. Rotation of the drill bit 10 typically continues at substantially the same rate during drilling of the formation 40. In many plastic formations, such as the aforementioned highly pressured or deep shales, mudstones, siltstones, some limestones and other ductile formations, a formation chip 42 cut by the cutting element 25 may actually be an elongated, substantially pliable chip 42 that will effectively flow over the cutting face 29 and adhere to the side wall 26 of the fluid course 23. As the formation 40 is cut, the pliable chips 42 cut by the cutting element 25 may build up in the fluid course 23, and eventually build up over the cutting face 29 of the cutting element 25, effectively balling the drill bit 10 and preventing it from efficiently drilling into the formation 40.

Figure 3:
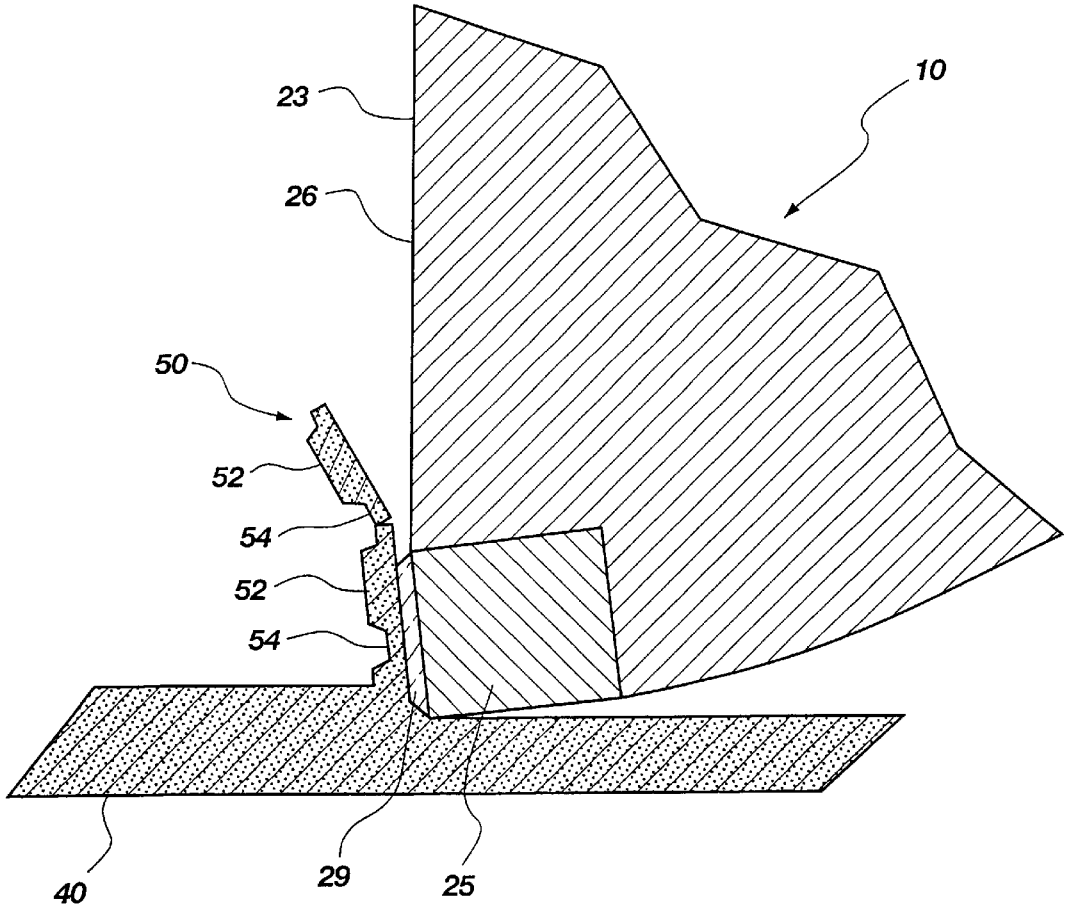
FIG. 3 is a partial view in cross-section of a formation chip being cut by a cutting element on a drill bit using a first embodiment of a drilling method in accordance with the present invention.

To overcome such problems as described in conventional drilling methods, the drill bit 10 and, thus the cutting elements 25 are oscillated in the present invention to create a formation chip 50 which has both relatively thick portions 52 and relatively thin portions 54, as illustrated in FIG. 3. In a first method of drilling in accordance with the present invention, illustrated in FIG. 3, the drill bit 10 and cutting elements 25 are rotatably and/or torsionally oscillated to create a formation chip having thick portions 52 and thin portions 54. As the thin portion 54 extends over the cutting face 29 of the cutting element, the thick portion 52 is left substantially unsupported such that drilling fluid contacting the leading thick portion 52 can break it from the next following thick portion 52 along the interconnecting thin portion 54. Thus, the chip 50 is broken into smaller sections before it can adhere to and build up on the side wall 26 of the fluid course 23 or on the cutting face 29. FIG. 3 illustrates a formation chip 50 having a thick portion 52 of substantial longitudinal length relative to the size of the cutting face 29 of the cutting element 25. Notably, increasing the frequency of oscillations causes the formation 40 to be cut in a manner which pulverizes the formation chips so that they can be carried away by the drilling fluid.

In some drilling operations, several different types of formations are encountered, ranging from relatively hard formations to relatively pliable formations. The rate of penetration of the bit 10 into the formation may typically be slower through hard formations and faster through softer formations. Knowing the pliability of the formation 40 at any given time, the various thick portions 52 and thin portions 54 of the formation chip 50 can be substantially predicted for a given WOB and rotational speed. Accordingly, when a formation 40 is encountered where balling of the bit 10 is of concern (i.e., adhesion of the formation chips 50 to the cutting elements 25 and bit body 12), the bit 10 may be selectively oscillated to produce a desired formation chip 50 profile, and when the bit 10 reaches a harder formation, the frequency of oscillation may be reduced or eliminated as necessary. Thus, the frequency of oscillation may be adjusted to optimize chip production for each of the different types of formation.

Figure 4:
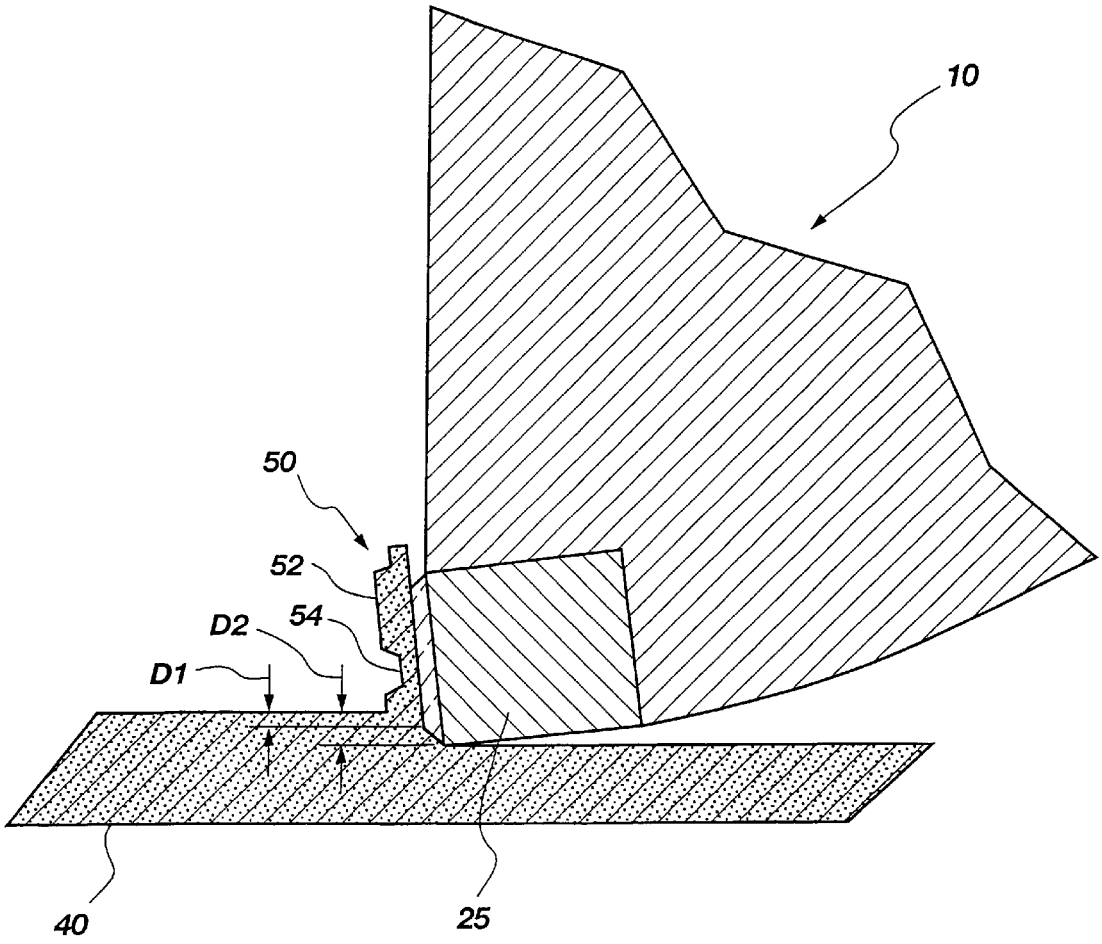
FIG. 4 is a partial view in cross-section of a formation chip being cut by a cutting element on a drill bit using a second embodiment of a drilling method in accordance with the present invention.

In FIG. 4, a second method according to the present invention is illustrated. In this method, a formation chip 50 having relatively thick portions 52 and relatively thin portions 54 is generated by the cutting element 25 under conditions where the normal force or WOB driving the bit 10 axially into the formation is cyclically varied. Accordingly, the cutting element 25 moves vertically or longitudinally relative to the formation 40 in a cyclical manner, cutting a depth D1 to produce the thick portions 52 of the formation chip 90 and a depth D2 to produce the thin portions 54 of the formation chip 50. In a similar fashion to that illustrated in FIG. 3, the thick portions 52 will break away from the rest of the formation chip 50 relatively easily and will break sequentially along the intervening thin portions 54.

Figure 5:
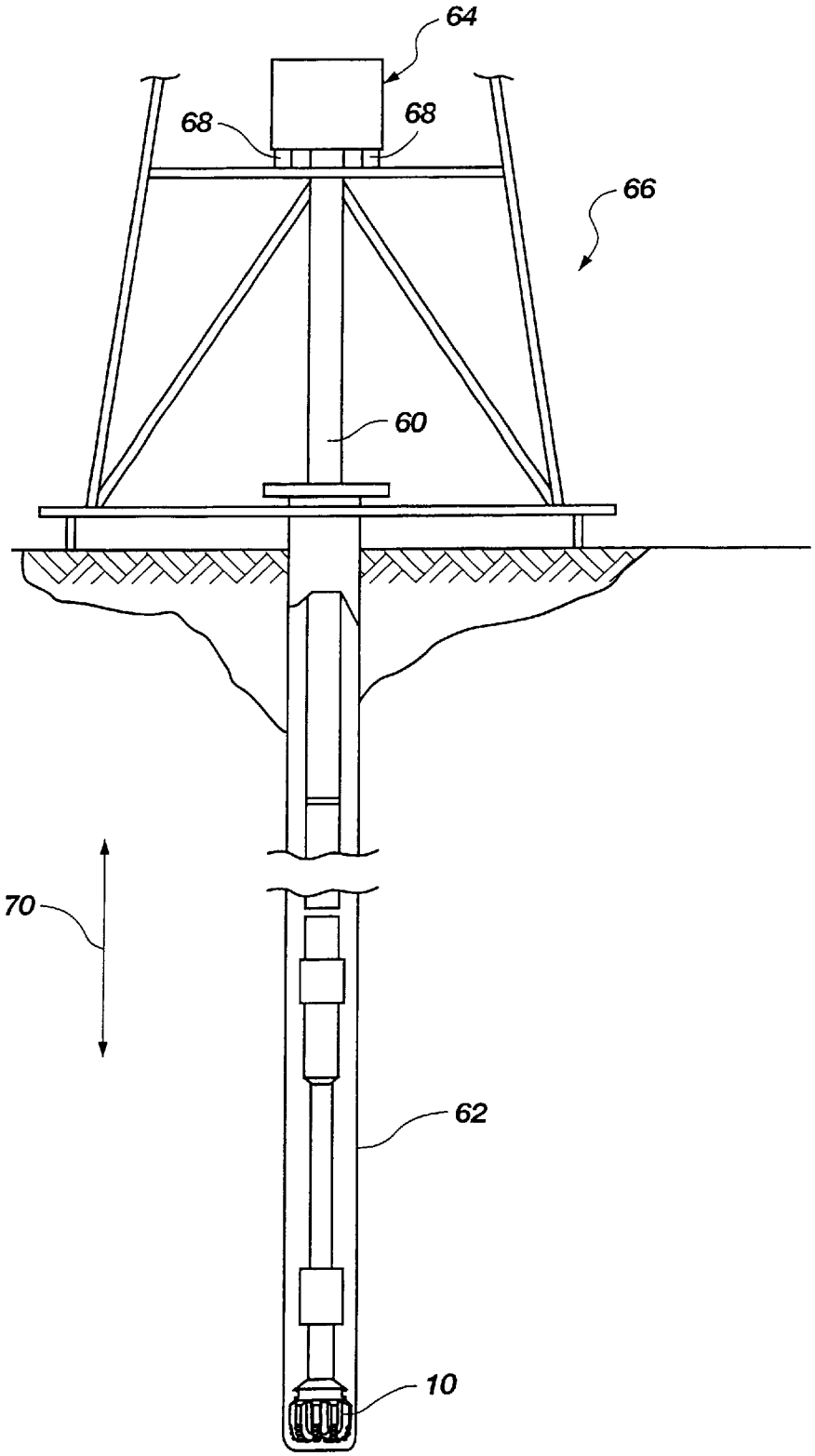
FIG. 5 is a view in elevation of an exemplary drilling apparatus having a motorized mechanism for providing vertical movement of the drill string to provide modified chip formation in accordance with the present invention.
Figure 6:
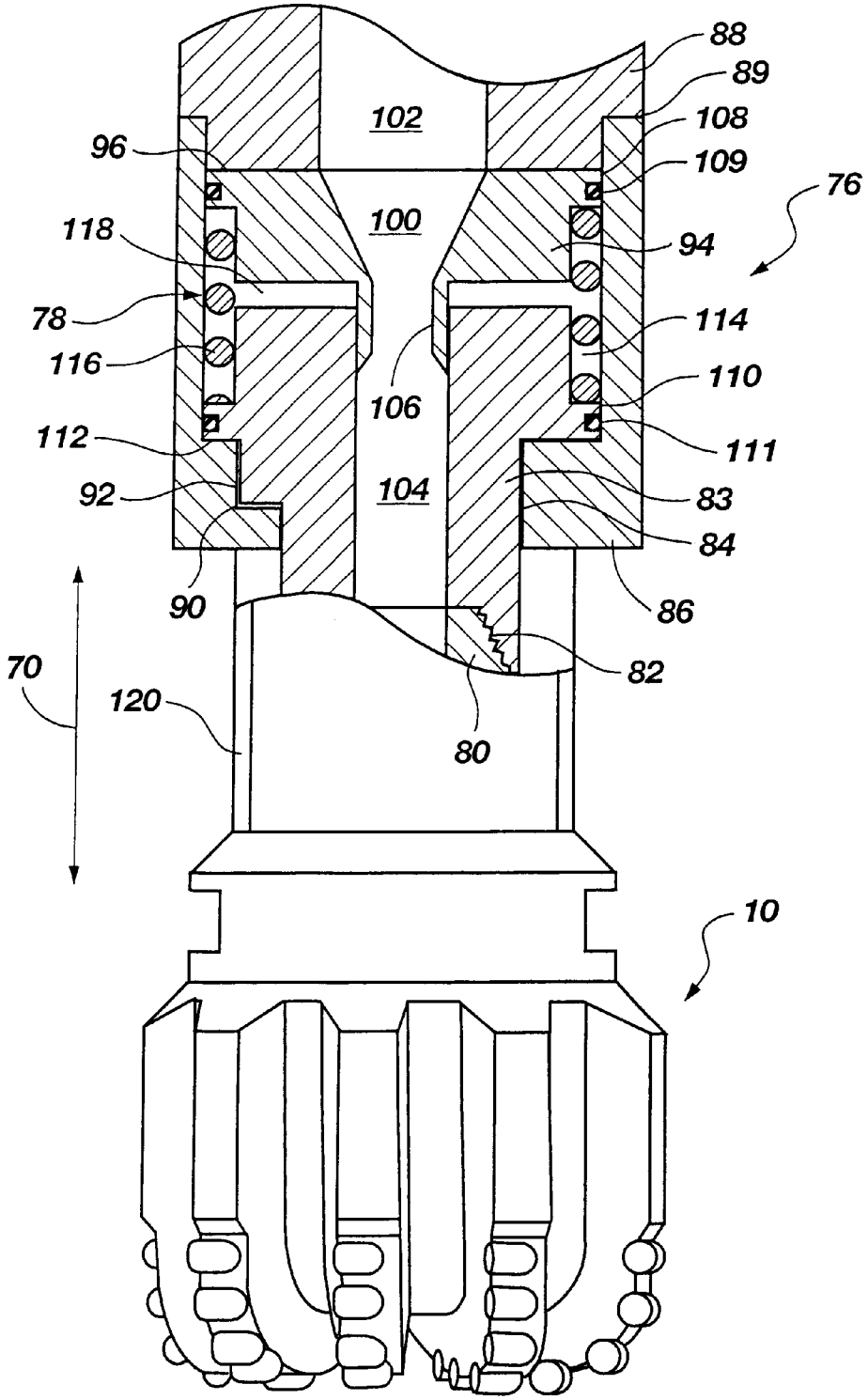
FIG. 6 is a view in elevation and in partial cross-section of a second embodiment of a rotary-type drill bit in accordance with the present invention.

The oscillating movement of the cutting elements, drill bit or drill string in the present invention to produce the desired profile of formation chips (i.e., alternating thick and thin portions) may be accomplished in various ways. FIG. 5, which schematically illustrates a formation drilling assembly, shows a drill string 60 positioned in a borehole 62 as it would be during a drilling operation. At the lower terminal end of the drill string 60 is a drill bit 10 positioned to cut into the formation. The drill string 60 is operatively connected to a rotary drive unit 64 which imparts rotational movement to the drill string 60 and, thus, to the drill bit 10. Axial oscillation of the drill bit 10 to produce formation chips 50, as shown in FIG. 4, may be achieved by imposing an axial oscillation or movement in the drill string 60. Such axial oscillation may be induced, for example, by securing the rotary drive unit 64 to a support 66 using a resilient mechanism 68 (e.g., springs) which allows the drill string 60 to cyclically oscillate in a vertical direction 70. The vertical oscillation imposed on the drill string 60 is translated to the drill bit 10, causing the drill bit 10, and thus the cutting elements, to contact the formation at varying depths to produce a formation chip 50 as shown in FIG. 4. Oscillation of the drill string 60 may also be achieved in a similar manner by cyclically varying the WOB imposed on the drill string above ground.

Vertical oscillation necessary to produce the formation chips 50 shown in FIG. 4 may also be achieved by imposing oscillation in the drill bit 10. A number of mechanisms may be employed to achieve oscillation in the drill bit 10, a representative sampling of which are illustrated in FIGS. 6–10. In the assembly illustrated in FIG. 6, for example, the drill bit 10 is attached to a near-bit sub 76 which houses a spring mechanism 78 for effecting an oscillating movement in the drill bit 10 in the direction of arrow 70. The drill bit 10 is attached to the near-bit sub 76 by any conventional structure, such as by securement of the threaded pin 80 of the drill bit 10 into a correspondingly threaded box 82 extending from the near-bit sub 76.

The spring mechanism 78 may comprise a shank 83 which is slidably positioned through an opening 84 formed in the bottom of a retainer housing 86 of the near-bit sub 76. The retainer housing 86 is, in turn, secured to an upper housing 88 of the near-bit sub 76. The retainer housing 86 and upper housing 88 may be joined, for example, at joint 89 by a weld, although other forms of securement may be used. The retainer housing 86 may preferably be formed with at least one keyway 90 extending about the opening 84 of the retainer housing 86 into which may be positioned a spline 92 radiating from the shank 83. The positioning of the spline 92 in the keyway go prevents the shank 83 from rotating relative to the retainer housing 86 during normal drilling operations. However, elimination of the keyway 90 may provide a slip clutch between an upper member 94 of the spring mechanism 78 and the shank 83 thereby providing torsional movement in the drill bit 10 as well.

The upper member 94 is sized to be retained inside the retainer housing 86 and is secured to the upper housing 88 of the near-bit sub 76. As illustrated, the upper member 94 of the spring mechanism 78 may be separately formed and secured to the upper housing 88 by, for example, a weld at a contact interface 96 between the upper member 94 and the upper housing 88. Other equally suitable means of securement may be employed however. Alternatively, the upper housing 88 and upper member 94 may be integrally formed as a single unit. The upper member 94 is configured with a centrally-located fluid channel 100 which communicates with a fluid channel 102 of the near-bit sub 76. The shank 83 is also configured with a fluid channel 104 which is in fluid communication with the fluid channel 100 of the upper member 94 to deliver drilling fluid to the drill bit 10. The upper member 94 is structured with a collar 106 which is slidably positioned within the fluid channel 104 of the shank 83 to prevent fluid from entering into the spring mechanism 78. A structure other than a collar 106 may be suitably employed to achieve a resilient seal between the upper member 94 and the shank 83.

The upper member 94 is configured with a flange 108 which is sized to be snugly received into the retainer housing 86. The flange 108 is structured to retain an o-ring 109 about the circumference thereof to provide a seal between the upper member 94 and the retainer housing 86. Likewise, the shank 83 is configured with a flange 110 which is snugly, but slidably received into the retainer housing 86 and which is positioned to contact an inner shoulder 112 of the retainer housing 86. The flange 110 is also structured to retain an o-ring 111 about the circumference thereof to provide a seal between the shank 83 and the retainer housing 86. An annular space 114 is formed between the flange 108 of the upper member 94 and the flange 110 of the shank 83 and a spring 116 is positioned about the upper member 94 and shank 83 within the annular space 114. The spring 116 has a high degree of rigidity which, in the non-drilling state, keeps the upper member 94 spaced from the shank 83, thereby providing a space 118 therebetween. Other resilient members, such as a rubber pad located within the space 118 formed between the upper member 94 and the shank 83, may be employed to resiliently maintain the upper member 94 in spaced relationship to the shank 83.

In operation, the shank 83 is maintained at a distance from the upper member 94 by the rigidity of the spring 116. However, with a cyclical increase in the WOB imposed on the drill string or near-bit sub 76, the spring 116 becomes slightly compressed, thereby allowing the shank 83 to slidably move toward the upper member 94, and the space 118 therebetween is reduced. Thus, the drill bit 10 may be caused to oscillate in an axial direction 70. Because there is inherent vibration of the drill bit 10 during drilling, the associated forces will facilitate the oscillation of the drill bit 10. Accordingly, the drill bit 10 can axially oscillate relative to the upper housing 88, and thus the drill string, resulting in the production of a formation chip 50 having relatively tick portions 52 and relatively thin portions 54 as illustrated in FIG. 4. A resilient sleeve 120 positioned about the shank 83 and pin 80 of the drill bit 10 allows the drill bit 10 to move axially while keeping debris from contacting the shank 83.

Figure 7:
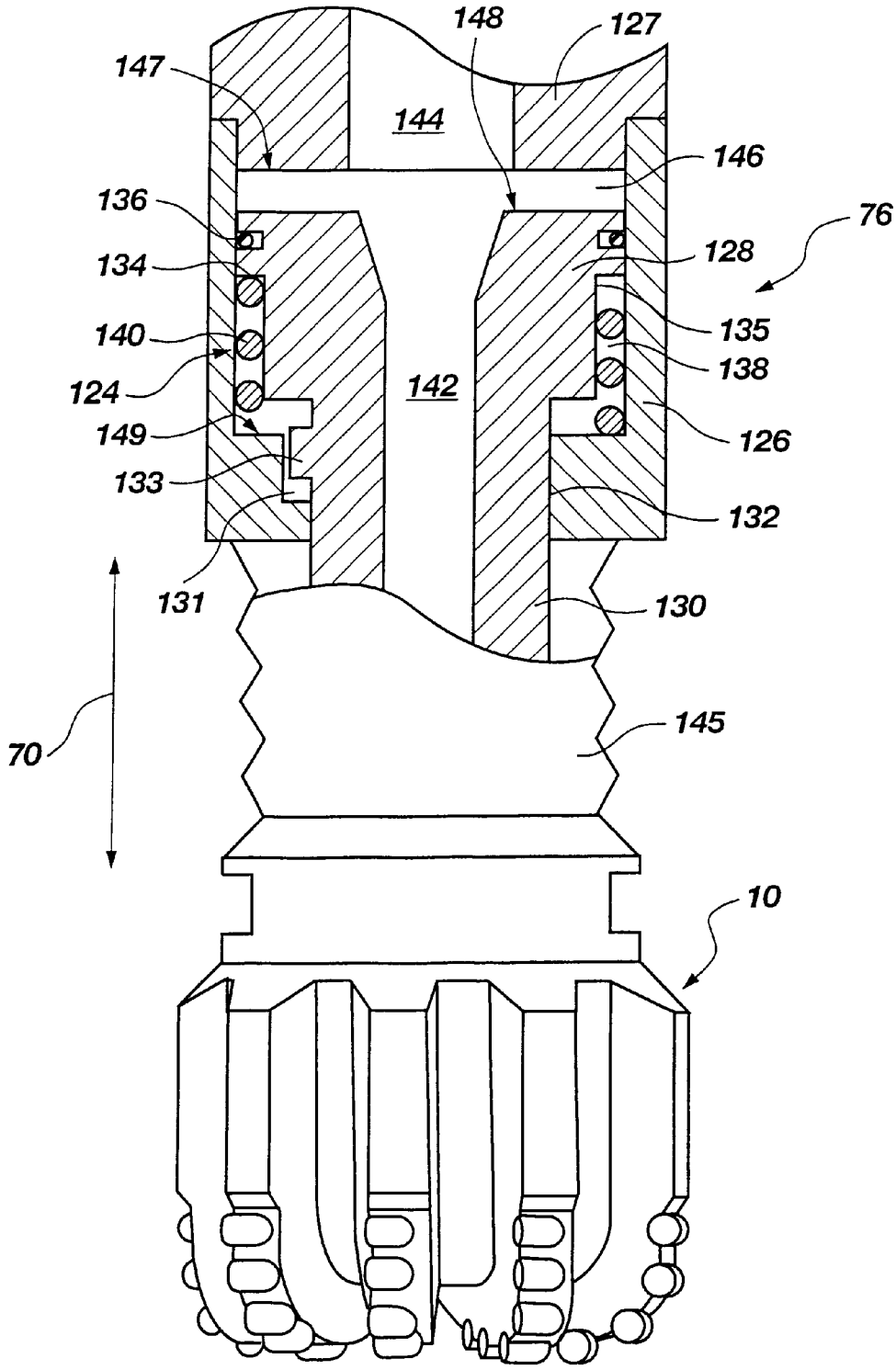
FIG. 7 is a view in elevation and in partial cross-section of a third embodiment of a rotary-type drill bit in accordance with the present invention.

In a second embodiment of a drill bit 10 structured to axially oscillate, illustrated in FIG. 7, the drill bit 10 may be attached to a near-bit sub 76 which is structured to house an alternative type of spring mechanism 124. The near-bit sub 76 may be structured with a retainer housing 126 sized to receive the spring mechanism 124 therein. The retainer housing 126 is secured to an upper housing 127 of the near-bit sub 76. The spring mechanism 124 in this embodiment comprises a body 128 positioned within the retainer housing 126 and a shank 130 extending from the body 128 through a central opening 132 of the retainer housing 126 through which the shank 130 is slidably received. The retainer housing 126 may be formed with at least one keyway 131 which is sized to receive a corresponding spline 133 formed on the shank 130 of the spring mechanism 124. The spline 133 is vertically slidable within the keyway 131 to allow the spring mechanism 124 to impart axial oscillation to the drill bit 10, but prevents rotation of the drill bit 10 relative to the near-bit sub 76 during drilling operations.

The body 128 of the spring mechanism 124 is configured with a flange 134 which is sized to fit snugly circumferentially within the retainer housing 126. The flange 134 is structured to receive an o-ring 136 which maintains a seal between the retainer housing 126 and the flange 134 of the spring mechanism 124. The body 128 is also formed with a portion adjacent the flange 134 which has an outer perimeter surface 135 that is of less circumferential dimension than the circumferential dimension of the flange 134, thereby providing an annular space 138 about the body 128. A rigid spring 140 is positioned within the annular space 138 and about the body 128 of the spring mechanism 124.

The body 128 and shank 130 of the spring mechanism 124 are configured with a fluid channel 142 which receives drilling fluid moving from a fluid channel 144 of the near-bit sub 76 and delivers the drilling fluid to the drill bit 10. The body 128 is also sized so that a gap 146 is provided between the bottom surface 147 of the upper housing 127 of the near-bit sub 76 and the upper surface 148 of the body 128. The body 128 is also sized so that when drilling is not taking place, the rigid spring 140 maintains the body 128 of the spring mechanism 124 in spaced relation to the internal shoulder 149 of the retainer housing 126. During drilling operations, drilling fluid flowing through the fluid channel 144 of the near-bit sub 76 fills the gap 146 and flows trough the fluid channel 142 of the spring mechanism 124, While an amount of hydrostatic pressure results from the flow of drilling fluid, the spring 140 is normally sufficiently rigid to maintain the body 128 at a spaced distance from the internal shoulder 149 of the retainer housing 126. However, vertical oscillation of the drill bit 10 may be produced by selectively and alternatively increasing and decreasing the flow of drilling fluid through the fluid channel 144 to thereby generate a pulsing action, or axial oscillation, in the drill bit 10. A resilient sleeve 145 may be positioned about the shank 130 of the spring mechanism 124 to prevent fluid and debris from contacting the shank 130.

Figure 8:
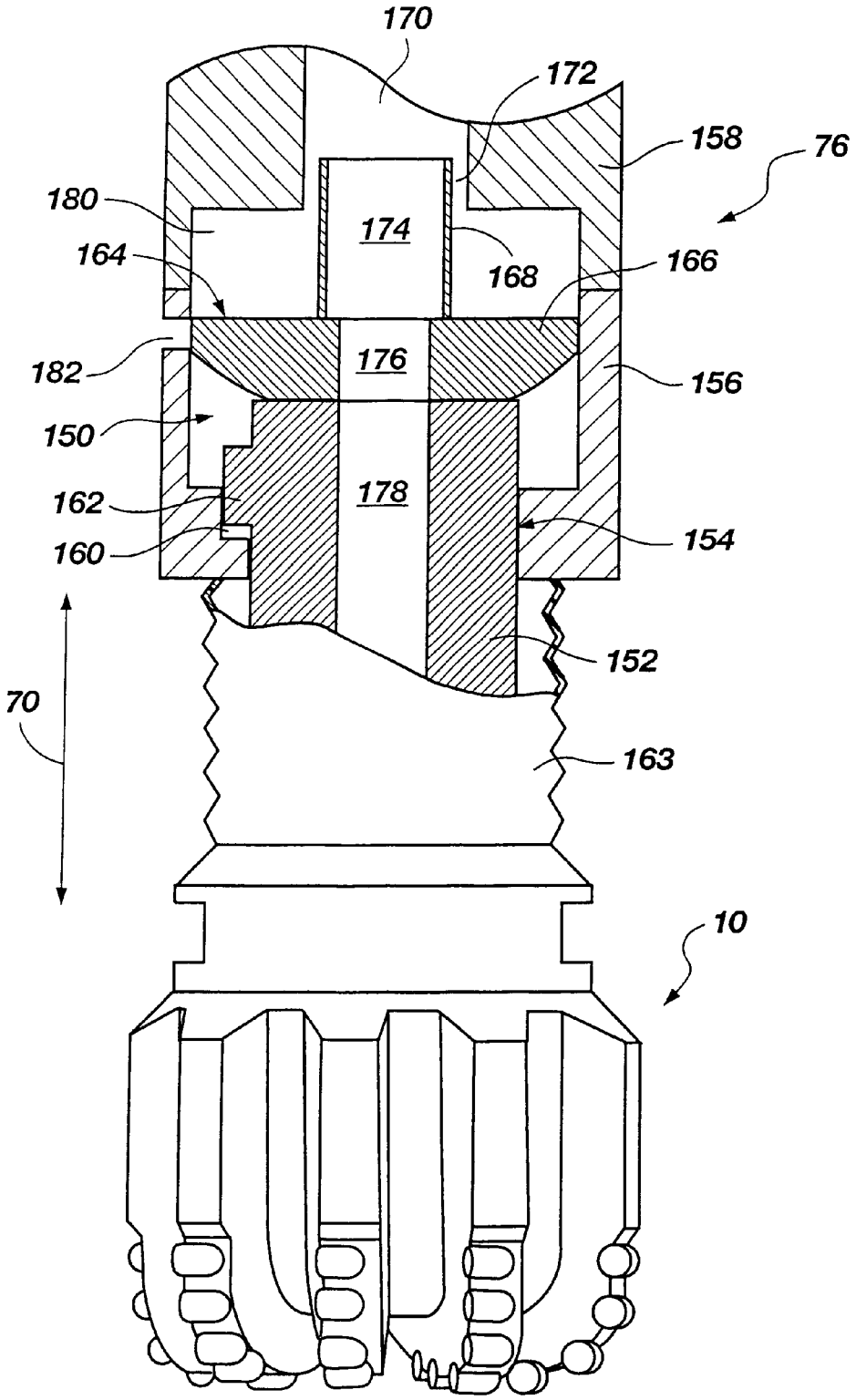
FIG. 8 is a view in elevation and in partial cross-section of a fourth embodiment of a rotary-type drill bit in accordance with the present invention.

In a third embodiment illustrated in FIG. 8, the hydrostatic pressure provided by the drilling fluid moving through the near-bit sub 76 is used to produce axial oscillation in the drill bit 10 using a pressure release mechanism 150. The pressure release mechanism 150 is housed within the near-bit sub 76 and comprises a shank portion 152 slidably received within an opening 154 formed in the bottom of a retainer housing 156 of the near-bit sub 76. The retainer housing 156 is secured to an upper housing 158 of the near-bit sub 76. The retainer housing 156 is formed with at least one keyway 160 extending radially outward from the opening 154 and is sized to slidably receive a spline 162 formed in the shank portion 152. The spline 162 is able to move vertically within the keyway 160 as the shank portion 152 oscillates, but the spline 162 and keyway 160 keep the shank portion 152 from rotating relative to the near-bit sub 76. A resilient sleeve 163 may be positioned about the shank portion 152 to keep fluid and debris from the opening 154 of the retainer housing 156.

The pressure release mechanism 150 includes a valve member 164 which is secured to the shank portion 152. The valve member 164 includes a plunger-like portion 166, the circumferential dimension of which allows the valve member 164 to fit snugly and slidably within the retainer housing 156 of the near-bit sub 76. The valve member 164 is also structured with an upstanding hollow throat 168, which is in axial alignment with the fluid channel 170 of the upper housing 158 of the near-bit sub 76, and is positioned to be slidably receivable in the fluid channel 170. The hollow throat 168 is sized in circumferential dimension to provide an annular space 172 between the hollow throat 168 and the fluid channel 170 for movement of drilling fluid therethrough. The hollow throat 168 defines a fluid channel 174 which is positioned to receive drilling fluid from the fluid channel 170 of the upper housing 158 of the near-bit sub 76 and is in fluid communication with a fluid channel 176 formed in the plunger-like portion 166 and a fluid channel 178 formed through the shank portion 152. Thus, drilling fluid is able to move through the axially aligned series of fluid channels 170, 174, 176, 178 to deliver fluid to the drill bit 10 and is able to move through the annular space 172 formed about hollow throat 168 to fill a chamber 180 defined by the retainer housing 156, upper housing 158 and valve member 164.

In operation, as drilling fluid moves through the drill string and through the near-bit sub 76, a greater portion of drilling fluid moves through the hollow throat 168 to the drill bit 10 while a smaller portion of drilling fluid moves through the annular space 172 to fill the chamber 180 with drilling fluid. As the chamber fills and pressure in the chamber 180 increases, the valve member 164 is forced downward, which also results in the shank portion 152 being forced downward. At least one opening 182 formed in the retainer housing 156 provides an opening through which drilling fluid may escape when the valve member 164 is forced downward a sufficient distance to allow the plunger-like portion 166 of the valve member 164 to clear the opening 182. Thus, when sufficient pressure builds within the chamber, the valve member 164 is moved downward a sufficient distance to allow drilling fluid to escape the chamber 180 and pressure is released, causing the valve member 164 to move axially upward again until sufficient pressure builds in the chamber 180 again to produce a release in drilling fluid from the chamber 180. A sufficient amount of pressure build-up and release is generated to produce oscillation of the drill bit 10 to provide a cutting of the formation as shown in FIG. 4.

Figure 9:
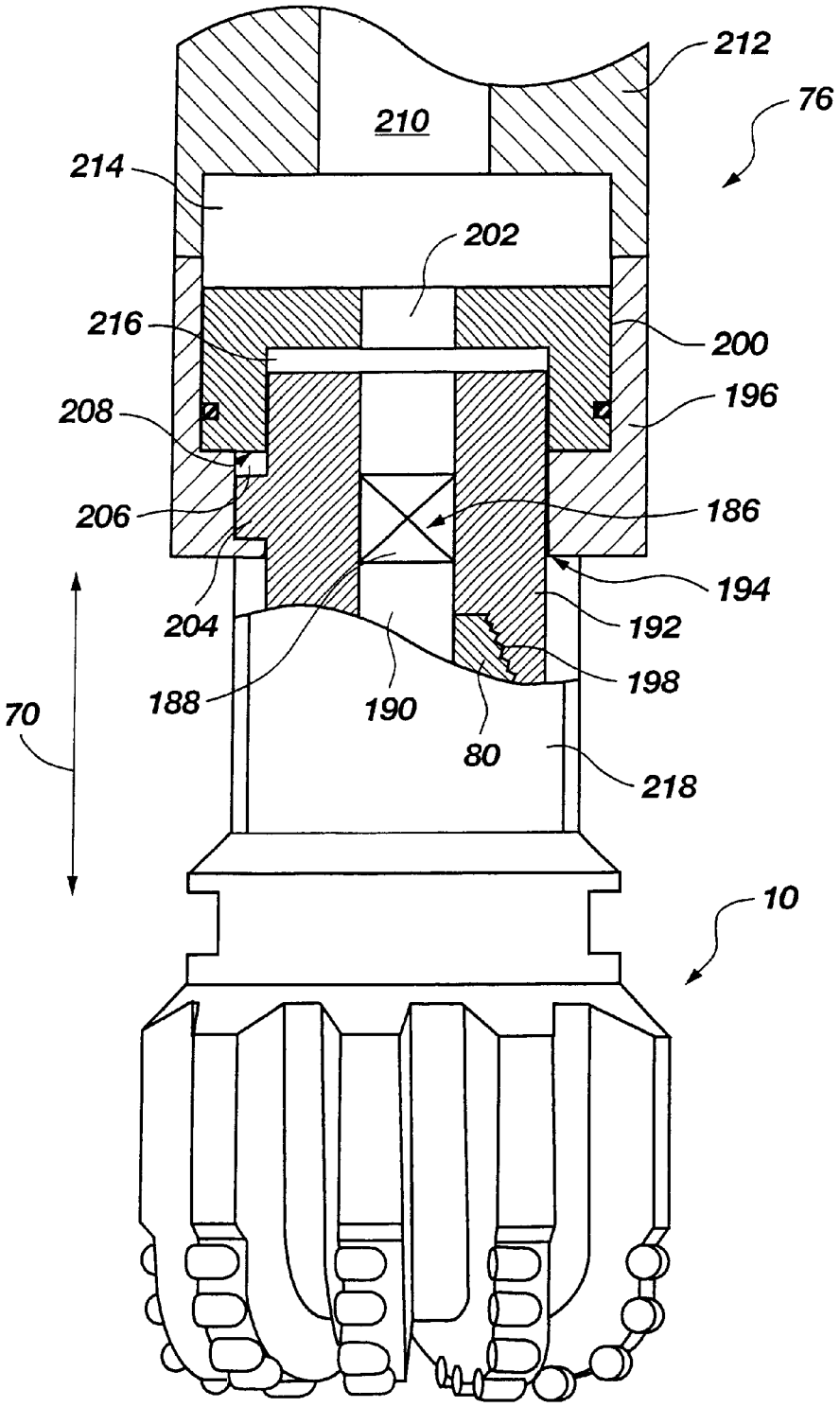
FIG. 9 is a view in elevation and in partial cross-section of a fifth embodiment of a drill bit in accordance with the present invention.

In a fourth embodiment illustrated in FIG. 9, axial oscillation of the drill bit 10 is induced by use of an oscillation mechanism 186 which employs the pressure of drilling fluid moving through the drill string to cause a vibration or oscillation of the drill bit 10 in the direction of arrow 70. The oscillation mechanism 186 may be any suitable device which can operate to impose oscillation of the drill bit 10 relative to the drill string or, as shown, relative to a near-bit sub 76. By way of example, one such device may be an oscillation valve 188 positioned within the fluid channel 190 of a shank 192 slidably positioned within the opening 194 of a retainer housing 196 of a near-bit sub 76. The shank 192 is secured to the drill bit 10 by any conventional device, such as threaded securement of the pin 80 of the drill bit 10 to a correspondingly threaded box 198 of the shank 192.

The shank 192 is slidably movable through an opening 194 in the retainer housing 196, but the upper limit of movement of the shank 192 is defined by a stop member 200 housed within the retainer housing 196. The stop member 200 may preferably be configured to fit snugly within the retainer housing 196 and provide a fluid seal between the stop member 200 and the retainer housing 196, except for a fluid channel 202 formed in the center of the stop member 200 which is axially aligned with the fluid channel 190 of the shank 192. Vertical movement of the shank 192 is also limited by the movement of a spline 204 of the shank 192 within a corresponding keyway 206 formed in the retainer housing 196 in radial position about the opening 194. There may be at least one such keyway 206 formed in the retainer housing 196. The spline 204 not only limits the axial movement of the shank 192 by contacting the bottom surface 208 of the stop member 200, but prevents rotation of the shank 192 during drilling.

In operation, drilling fluid moving through the drill string (not shown) enters a fluid channel 210 formed in the upper housing 212 of the near-bit sub 76 and fills a chamber 214 defined by the upper housing 212, the retainer housing 196 and the stop member 200. Weight imposed on the drill bit 10 by the drill string, or WOB, causes the shank 192 to contact the stop member 200. Additionally, as drilling fluid continues to move through the fluid channel 202 of the stop member 200 and into the fluid channel 190 of the shank 192, the fluid pressure forces the shank 192 away from the stop member 200, thereby providing a space 216 between the stop member 200 and the shank 192. Fluid fills the space 216 and exerts sufficient pressure to provide a cushioning effect between the stop member 200 and the shank 192. Drilling fluid moving through the oscillation mechanism 186, here represented as an oscillation valve 188, causes the shank 192 to vibrate or oscillate in the direction of arrow 70. The shank 192 oscillates enough to provide contact with the formation in the manner shown in FIG. 4 to produce formation cuttings 50 of the type shown in FIG. 4. Again, a resilient sleeve 218 may be positioned about the shank 192 to keep debris and fluid from clogging the opening 194 of the retainer housing 196.

Figure 10:
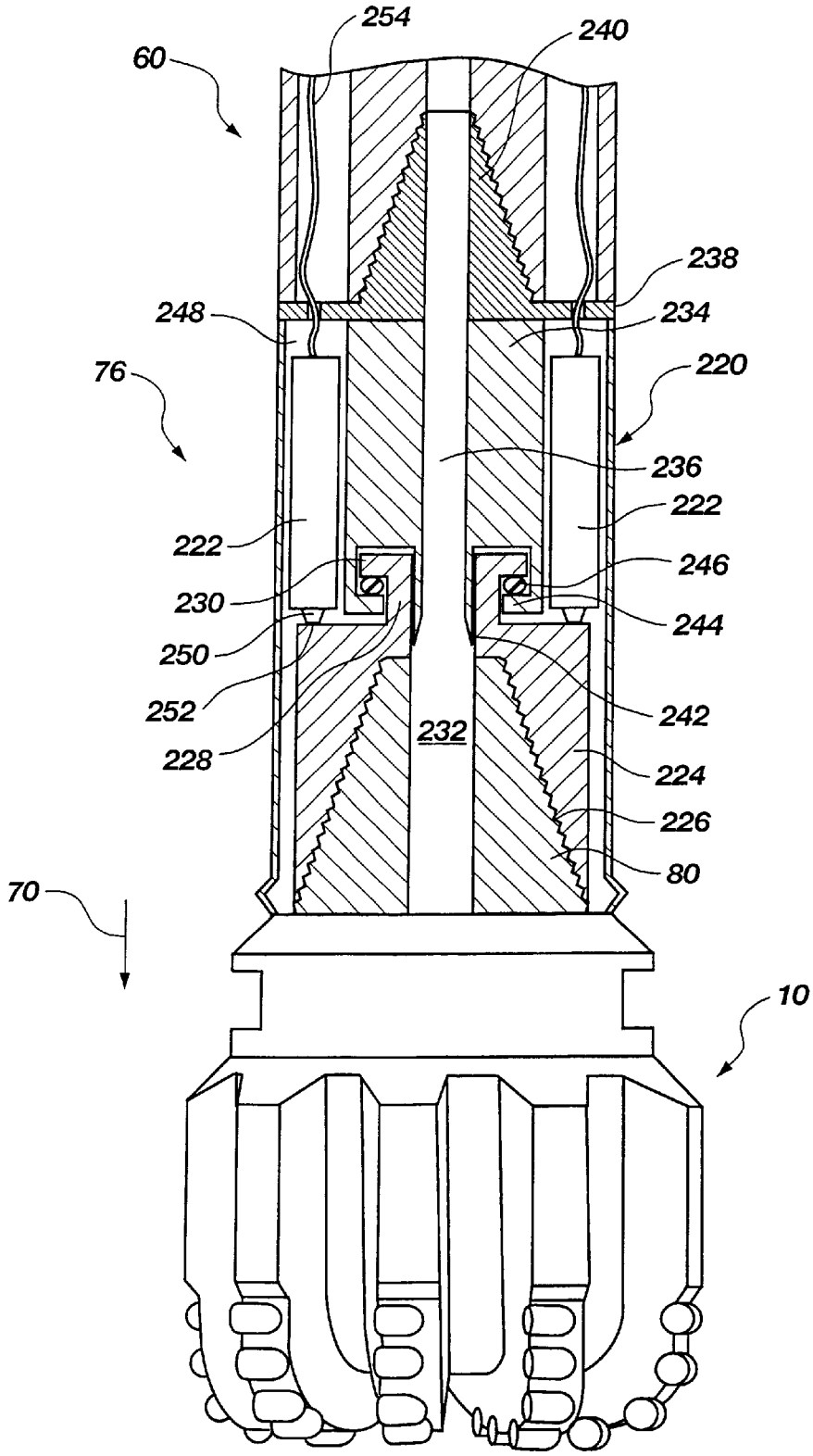
FIG. 10 is a view in elevation and in partial cross-section of a sixth embodiment of the present invention structured to provide vertical oscillation to the drill bit.

In a fifth embodiment of the invention illustrated in FIG. 10, the drill bit 10 may be made to vertically oscillate by providing at least one vibration mechanism 220 which receives electrical signals from above-ground. One possible method of providing vibration in the drill bit 10 is shown in FIG. 10 where one or more electrically-driven vibrating pistons 222 are housed within a near-bit sub 76. The drill bit 10 is connected to a retainer cylinder 224 of the near-bit sub 76 by any suitable device, such as threaded securement of the pin 80 of the drill bit 10 with a correspondingly threaded box 226 of the retainer cylinder 224. The retainer cylinder 224 is structured with a centrally-located fluid channel 232 which delivers drilling fluid to the drill bit 10. The retainer cylinder 224 is further structured with a centrally-located upstanding collar 228 having an outwardly-extending flange 230.

The near-bit sub 76 may further comprise an articulating cylinder 234 structured with a central channel 236 which is axially aligned with the fluid channel 232 of the retainer cylinder 224 to communicate drilling fluid from the drill string 60 to the drill bit 10. The articulating cylinder 234 is secured to an end plate 238 of the near-bit sub 76 which, in turn, may be fitted with a threaded pin 240 or other device for securement of the near-bit sub 76 to the next adjacent section of the drill string 60. The articulating cylinder 234 may be configured with a collar 242 which is sized to extend into the fluid channel 232 of the retainer cylinder 224 and register thereagainst so that fluid moving through the central channel 236 of the articulating cylinder 234 and the fluid channel 232 does not flow between the retainer cylinder 224 and the articulating cylinder 234. The articulating cylinder 234 is further configured with an inwardly-extending flange 244 which is axially aligned with the flange 230 of the retainer cylinder 224 and is spaced therefrom. A resilient and compressible ring 246 is positioned between the flange 230 of the retainer cylinder 224 and the inwardly-extending flange 244 of the articulating cylinder 214 to cushion the movement of the retainer cylinder 224 relative to the articulating cylinder 234 and maintain the spacing between the flange 230 and the inwardly-extending flange 244, as described more fully below.

The articulating cylinder 234 may generally be structured with a smaller circumferential dimension than the retainer cylinder 224, thereby providing an annular space 248 about the articulating cylinder 234 in which the vibrating pistons 222 may reside as shown. Alternatively, the articulating cylinder 234 may be structured with openings sized in length and diameter sufficient to house the vibrating pistons 222 therein. The vibrating pistons 222 are positioned so that a vibrating tip 250 of the piston 222 contacts an upper surface 252 of the retainer cylinder 224. In operation, as an electrical signal is sent via appropriate wiring 254 to each vibrating piston 222, the tip 250 of each piston 222 contacts the upper surface 252 of the retainer cylinder 224 and causes a momentary downward force on the retainer cylinder 224, and thus the drill bit 10. The outwardly-extending flange 230 of the retainer cylinder 224 is momentarily forced toward the inwardly-extending flange 244 of the articulating cylinder 234, such movement being cushioned by the resilient ring 246. As the electrical signal is intermittently discontinued, the ring 246 forces the inwardly-extending flange 244 of the articulating cylinder 234 away from the flange 230 of the retainer cylinder 224 again. The intermittent application of power to the vibrating pistons 222 causes an axial vibration in the drill bit 10 which, in turn, produces a formation chip 50 as shown in FIG. 4.

Figure 11:
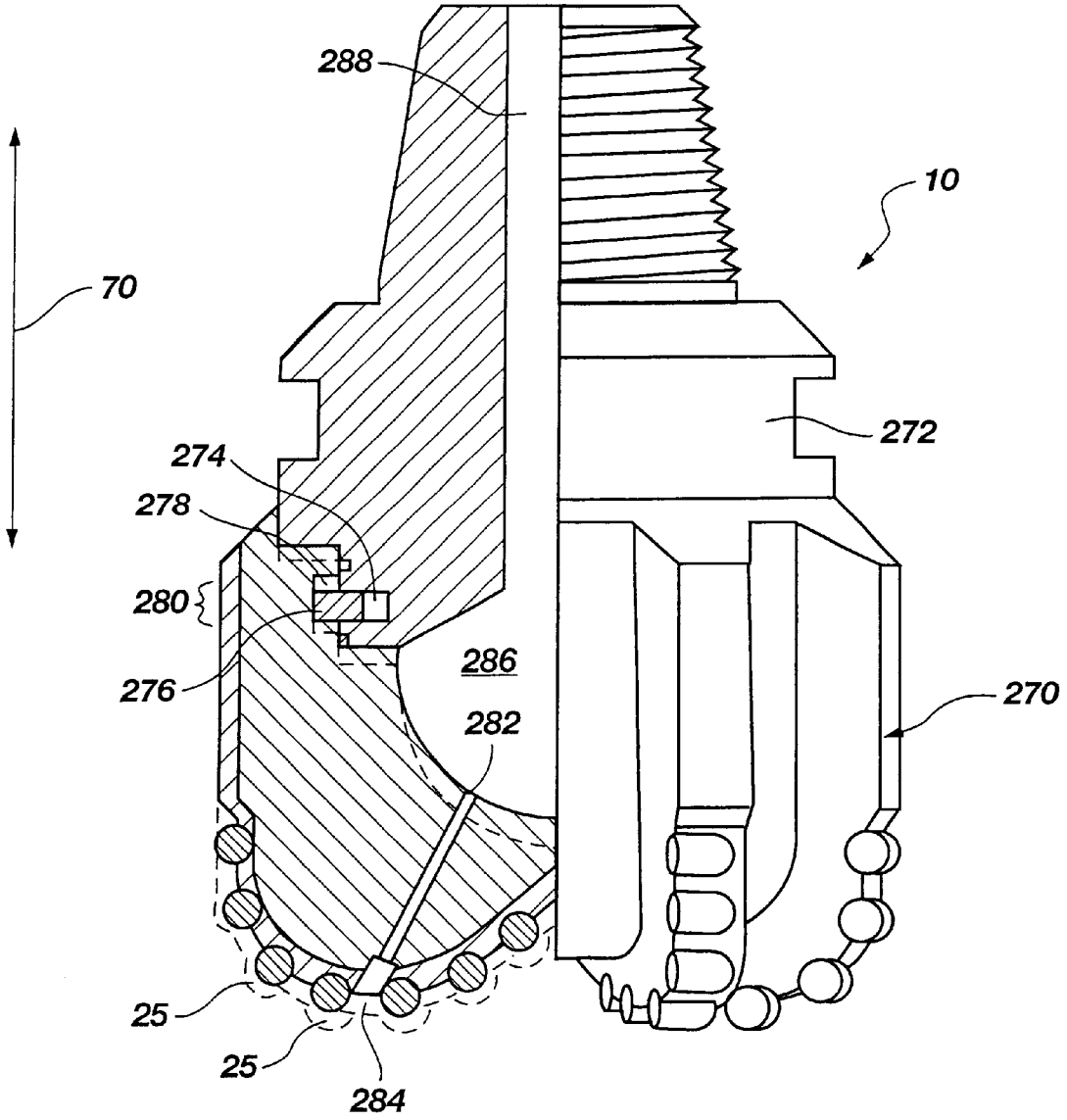
FIG. 11 is a view in elevation and in partial cross-section of a seventh embodiment of the present invention structured to provide movement in the cutting elements relative to the drill bit.

While the previously described embodiments of the invention have illustrated how vertical oscillation of the drill bit 10 may be produced by movement of the drill bit 10 relative to a near-bit sub 76, FIG. 11 illustrates how relative axial oscillation of bit components can also be produced to achieve formation chips 50, as shown in FIG. 4, by providing a drill bit 10 which is structured with a bit crown 270 which is movable in relation to the bit shank 272. Specifically, the bit shank 272 is configured with an annular groove 274 which encircles the lower portion of the bit shank 272. The annular groove 274 is sized to receive a resilient split ring 276. The bit crown 270 is provided with an annular race 278 which is positioned to align with the annular groove 274 of the bit shank 272 when the bit crown 270 is secured to the bit shank 272 as shown. The annular race 278 is sized to receive a portion of the resilient split ring 276 such that the split ring 276 resides within both the annular groove 274 and the annular race 278. As shown, the depth 280 of the annular race 278 is greater than the width of the resilient split ring 276 so that the bit crown 270 is capable of moving in an axial direction 70, as suggested by the broken lines shown.

The bit crown 270 is formed with a plurality of fluid passageways 282 which extends from the exterior 284 of the bit crown 270 to a plenum 286 defined between the bit crown 270 and the bit shank 272. In operation, when drilling fluid is delivered through the central channel 288 of the bit shank 272 to the plenum 286 for communication through the fluid passageways 282, and when the pressure within the plenum increases a sufficient amount to overcome the WOB exerted on the bit crown 270, the bit crown 270 is forced downward away from the bit shank 270 which, in turn, causes the cutting elements 25 to extend further into the formation. Pulsing action in the drilling fluid causes fluctuating increases and decreases in pressure within the plenum 286, thereby providing a vertical oscillation in the bit crown 270 relative to the bit shank 272.

Figure 12:
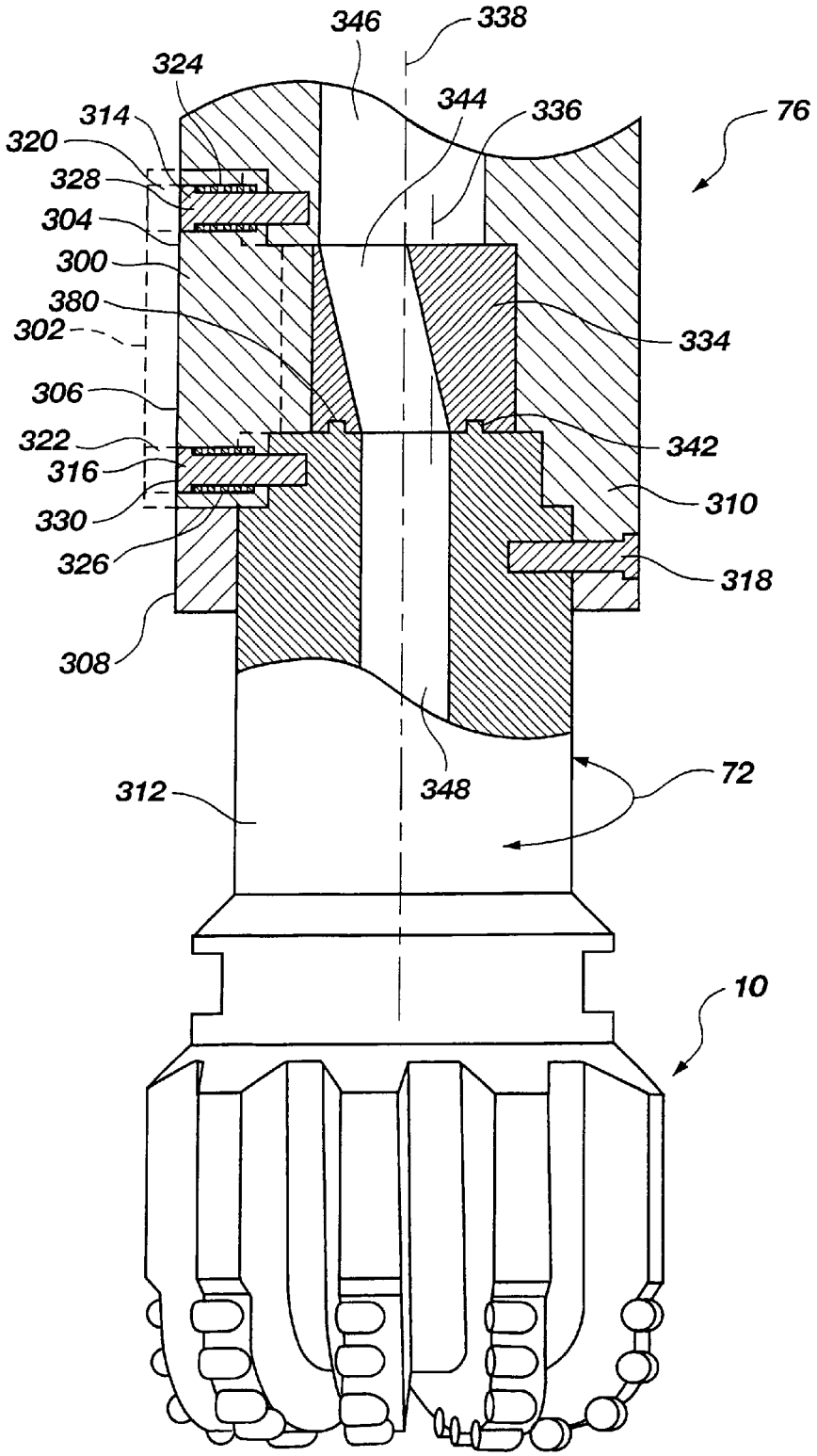
FIG. 12 is a view in elevation and in partial cross-section of an eighth embodiment of the present invention structured to provide torsional oscillation in the drill bit.

FIG. 12 illustrates a different embodiment of the present invention where the varying degree to which the drill bit impacts the formation is provided by torsional oscillation 72 of the bit 10, Torsional oscillation in the bit 10 may be accomplished by providing a pulsing hole wall brake 300 variably positionable within a near-bit sub 76 to oscillate between a wall-engaged position 302, represented by broken lines, and a wall disengaged position 304. In the wall-disengaged position 304, the brake 300 is slidably movable within the near-bit sub 76 for residence therewithin such that the outer surface 306 of the brake 300 is substantially flush with the outer surface 308 of an upper segment 310 of the near-bit sub 76. The brake 300 is secured to the near-bit sub 76, though slidably movable relative thereto, by a pair of threaded fasteners 314, 316 which are secured to the upper segment 310 and a lower segment 312, respectively, of the near-bit sub 76. In addition, a fastener 318, such as a bolt or other suitable device, may be employed to prevent rotation of the lower segment 312 relative to the upper segment 310 during drilling. The threaded fasteners 314, 316 are positioned through holes 320, 322 formed in the hole wall brake 300 and each fastener is encircled by a coiled spring 324, 326 which biases the brake 300 against the head 328, 330 of either threaded fastener 314, 316 during slidable movement of the brake 300 from the wall-engaging position 302 to the wall-disengaging position 304, Housed within the upper segment 310 and retained against the lower segment 312 is an offset orbiting member 334, having a centerline 336 which is offset from the centerline 338 of the upper segment 310. The orbiting member 334 is provided with a radial race 340 into which an upwardly extending protrusion 342 extends to maintain rotation of the orbiting member 334 about the centerline 338 of the upper segment 310. The orbiting member 334 is provided with a fluid course 344 extending the longitudinal length of the orbiting member 334 and which is in fluid communication with the fluid passage 346 of the upper segment 310 and with the fluid passage 348 of the lower segment 312. Flow of drilling fluid through the fluid course 344 of the orbiting member 334 causes the orbiting member to rotate, thereby effecting a spiral rotation of the fluid course 344. With rotation of the orbiting member 334, the brake 300 is intermittently forced outward toward the wall (not shown) of the formation to engage the wall. As the orbiting member 334 rotates further, the hole wall brake 300 returns to its wall-engaging position 302. Engagement of the brake 300 with the formation may also be encouraged by cyclically varying fluid pressure moving through the fluid passage 146 into the fluid course 144 of the orbiting member 334. With intermittent movement of the brake 300 from a wall-engaging position 302 to a wall-disengaging position 304, torsional oscillation of the drill bit 10 is provided to, in turn, provide a variable cut in the formation.

Figure 13:
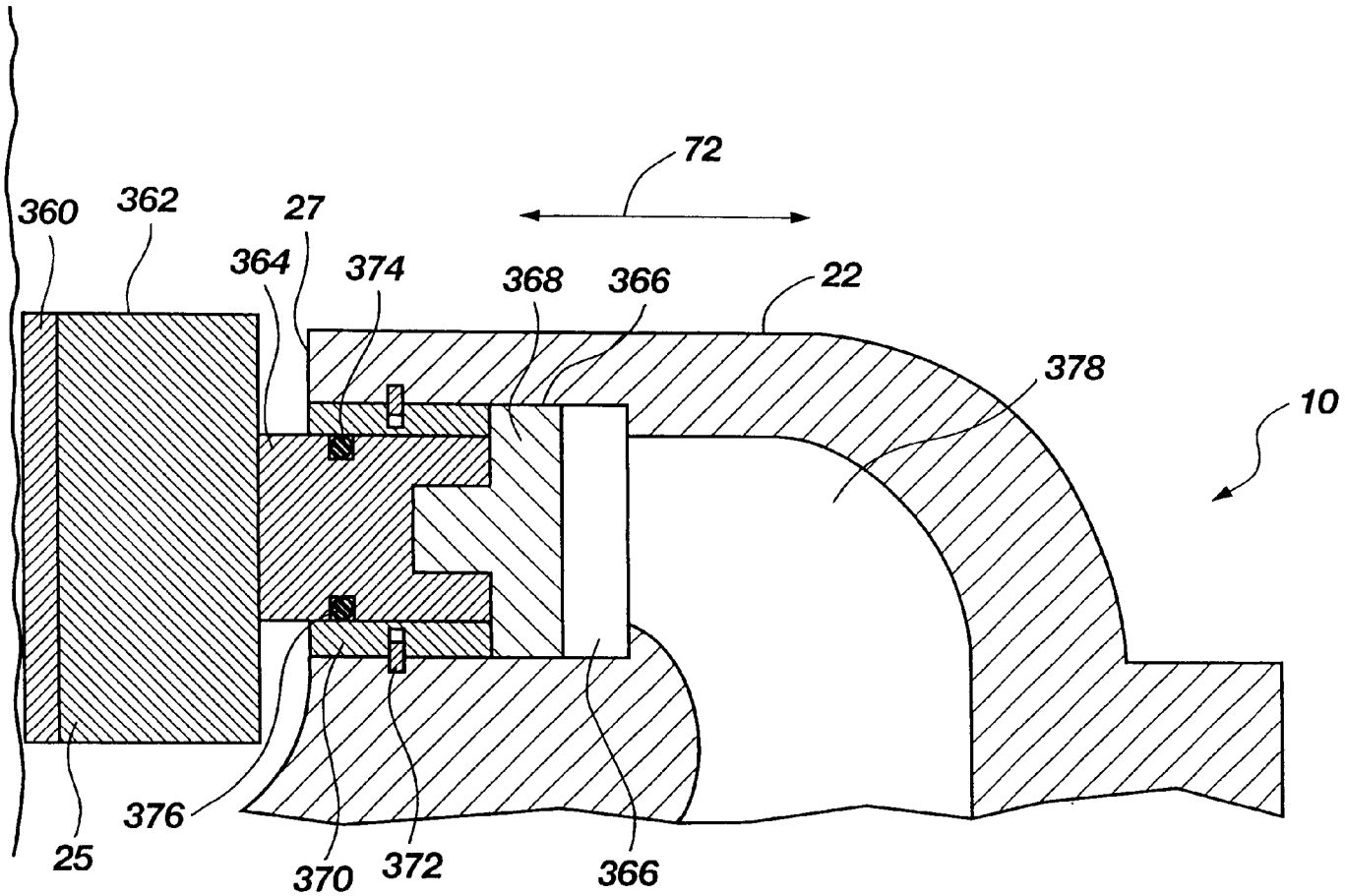
FIG. 13 is a partial view in cross-section of a drill bit blade illustrating a ninth embodiment of the present invention structured to provide movement in the cutting elements.

As illustrated in FIG. 13, other bit configurations may be employed to impart torsional oscillation, represented by arrow 72, to the bit 10 or, more precisely, portions thereof. In this embodiment, the bit 10 may be provided with a plurality of movable cutting elements 25 positioned along the leading edge 27 of each blade 22 of the bit 10. Each cutting element 25 has a cutting face 360 and a support 362, and further comprises a stem 364 which is housed within a socket 366 formed in the blade 22 of the bit 10 in a piston-like arrangement. The socket 366 is sized and shaped to receive a piston member 368 which is secured to the stem 364. A cylindrical sleeve 370 encircles the stem 364 and is held within the socket 366 by a split retaining ring 372. The stem 364 is slidably movable relative to the cylindrical sleeve 370. The stem 364 is provided with a circumferential groove 374 which houses an O-ring 376 to seal the stem 364 relative to the cylindrical sleeve 370. The socket 366 is in fluid communication with a fluid passageway 378 which receives drilling fluid from the drill string (not shown). When the fluid passageway 378 is pressurized by the flow of drilling fluid through the drill bit 10, the cutting element 25 is forced outwardly from the leading edge 27 of each blade 22 of the bit 10. By modulating the pressure of the drilling fluid exerted in the fluid passageway 378, the cutting element 25 may be oscillated relative to the blade 22, thereby achieving a chip formation as shown in FIG. 4.

Figure 14:
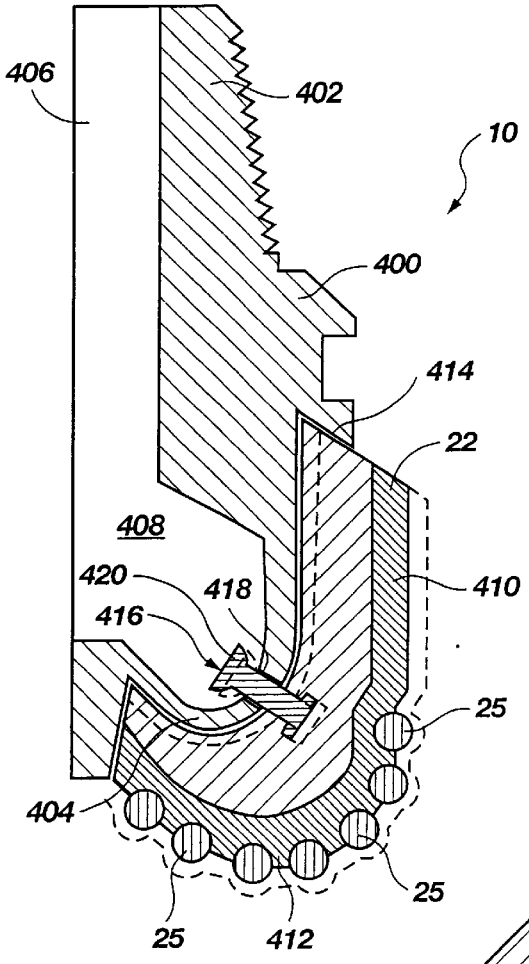
FIG. 14 is a partial view in longitudinal cross-section of one half of a drill bit illustrating a tenth embodiment of the present invention also structured to provide movement in the cutting elements.

Another method of achieving torsional oscillation in the drill bit 10 is illustrated in FIG. 14, which illustrates one half of a drill bit 10 in cross section. In this embodiment, the blades 22 (only one being shown) of the drill bit 10 are movable relative to a bit body 400, which comprises a combined bit shank 402 and bit crown 404. The bit 10 includes a central fluid channel 406 which delivers drilling fluid into a plenum 408 formed in the bit crown 404.

Although not specifically shown in FIG. 14, the bit 10 is also structured with fluid passageways which communicate with the exterior of the bit 10 to deliver drilling fluid into the formation. In the illustrated embodiment, the blades 22 of the bit 10 are formed with a conventional structure comprising a gage portion 410 and a crown, or bottom portion 412, which is positioned to engage the bottom of the formation during drilling. Cutting elements 25 are attached to each blade 22 in a conventional manner.

The bit body 400 is structured with a plurality of recesses 414 (only one being shown) which is sized and shaped to receive a blade 22 in a slidingly movable manner relative thereto, as suggested by the broken lines. Notably, the recesses 414 are sized such that blade 22 fits snugly into the recess 414 to avoid infiltration of dirt or other potentially clogging debris between the blade 22 and the recess 414. Each blade 22 is attached to the bit body 400 by a suitable device which allows the blade 22 to move outwardly from the bit body 10 in response to, for example, an increase in fluid pressure exerted within the plenum 408. By way of example only, the movable blade 22 may be secured to the bit body 400 at the crown 404 by a fastener 416, such as a pin or bolt, which is positioned through an opening 418 in the bit body 400 and which extends into the blade 22 for securement thereto. The fastener 416 may be configured with a head 420 which is sized or shaped to respond to increases in pressure within the plenum such that the head 420, and thus the fastener 416, may be forced outwardly from the plenum responsive to such pressure increases. Movement of the fastener 416 forces the blade 22 outwardly as well to drive the cutting elements into the formation. Thus, when the pressure in the plenum 408 overcomes the WOB exerted on the drill bit 10, and/or when the WOB exerted on the bit 10 is varied, the blades 22 are cyclically driven into the formation to produce a formation chip 50 as shown in FIG. 4.

Figure 15:
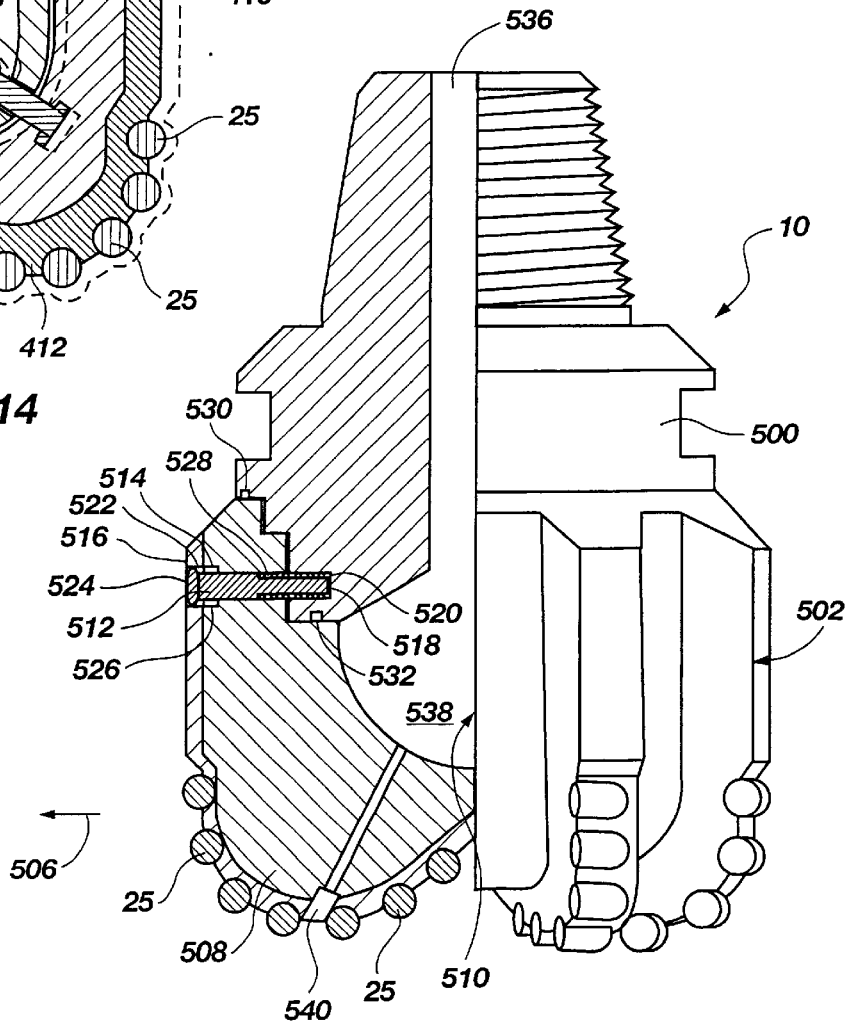
FIG. 15 is a view in elevation and in partial cross-section of an eleventh embodiment of the present invention also structured to provide movement in the cutting elements.

Movement of a portion of the drill bit 10 to achieve a variably shaped formation chip may be accomplished as illustrated in FIG. 15 where the drill bit 10 is again comprised of a separate bit shank 500 and bit crown 502 which are secured to each other in a movable manner, thereby allowing the bit crown 502 to move relative to the bit shank 500. This embodiment is distinguishable from the embodiment shown in FIG. 11 by providing a bit crown 502 which is outwardly or laterally movable, in the direction of arrow 506, from the bit shank 500. Thus, the bit crown 502 of this embodiment is comprised of a plurality of crown sections 508 which is slidably movable relative to each other along a lateral surface 510 as the bit crown 502 expands responsive to a pressure exerted from within the bit 10. It should be noted that the expansion of the bit crown 502 is relatively small (e.g., outward movement of from about one millimeter to about 5 millimeters) and the tolerances between the articulating crown sections 508 of the bit crown 502 are so small that the infiltration of dirt or other clogging material between the crown sections 508 is prevented.

The separate crown sections 508 comprising the bit crown 502 are each attached to the bit shank 500 by a fastener 512, such as a bolt or other suitable device, which is positioned through an opening 514 formed through the upper portion 516 of the section 508. The fastener 512 is secured at one end 518 to the bit shank 500 and may, for example, be threadingly engaged with a suitably sized and threaded opening 520 therein. The outer end 522 of the opening 514 is enlarged to accommodate the head 524 of the fastener 512 and provides a shoulder 526 against which the head 524 of the fastener comes in contact as the crown section 508 is moved outwardly under pressure. A spring 528 is positioned about a portion of the fastener and is biased between the opening 520 in the bit shank 500 and the fastener 512 to provide resilient movement of the crown section 508 relative to the bit shank. O-rings 530, 532 may be positioned between the crown section 508 and the bit shank 500 to provide a fluid-tight seal therebetween.

As drilling fluid moves through a central fluid channel 536 formed through the bit shank 500 and fills the plenum 538, pressure in the plenum increases. The drilling fluid moves through a plurality of fluid passageways 540 formed in the crown sections 508 to provide fluid to the formation. When hydrostatic pressure within the plenum increases to a point where the pressure overcomes the WOB, the crown sections 508 move outwardly in the direction of arrow 506 to contact the formation at a greater depth. Further varying the WOB, in concert with a cyclical variation of the fluid pressure, causes the cutting elements 25 to contact the formation in a manner to produce formation chips as shown in FIG. 4.

While the methods of achieving vertical and torsional oscillation of drill bits have been illustrated and described herein with respect to specific examples, those skilled in the art will appreciate that the structures and methods generally described may be adapted for use in a variety of situations or may be adapted to use with other types of bits, such as, for example, the drill bit having a tilting bit crown disclosed in U.S. Pat. No. 5,595,254 to Tibbitts and assigned to the assignee of the present invention. Thus, those skilled in the art will appreciate that one or more features of the illustrated embodiments may be combined with one or more features from another to form yet a further combination within the scope of the invention as described and claimed herein. Moreover, while certain representative embodiments and details have been shown for purposes of illustrating the invention, it will be apparent to those skilled in the art that various changes in the invention disclosed herein may be made without departing from the scope of the invention, which is defined in the appended claims.

What is claimed is:

1. An earth drilling device for variably contacting an earth formation, comprising:

a near bit sub member configured for attachment to the downhole end of a drill string;

a bit body attached to said near-bit sub member, said bit body having fixed cutting elements secured thereto and positioned to contact an earth formation; and apparatus associated with said near-bit sub member for producing a variable depth of cut by said fixed cutting elements into said earth formation while said bit body is rotated by said drill string and wherein said apparatus is structured to provide axial movement of said bit body relative to said near-bit sub member to produce a variable depth of cut by said fixed cutting elements into said earth formation during drilling, said apparatus comprising a lower member attached to said bit body and an upper member spaced from said lower member and biased with respect thereto by a resilient member providing movement of said lower member relative to said upper member.

2. An earth drilling device for variably contacting an earth formation comprising:

a near-bit sub member configured for attachment to the downhole end of a drill string;

a bit body attached to said near-bit sub member, said bit body having fixed cutting elements secured thereto and positioned to contact an earth formation; and apparatus associated with said near-bit sub member for producing a variable depth of cut by said fixed cutting elements into said earth formation while said bit body is rotated by said drill string and wherein said apparatus is structured to provide axial movement of said bit body relative to said near-bit sub member to produce a variable depth of cut by said fixed cutting elements into said earth formation during drilling, said apparatus comprising a retainer housing attached to said near-bit sub member, a portion of said bit body being slidably received and retained within said retainer housing and biased with respect thereto by a resilient member producing movement of said bit body relative to said near-bit sub member.

3. An earth drilling device for variably contacting an earth formation, comprising:

a near-bit sub member configured for attachment to the downhole end of a drill string;

a bit body attached to said near-bit sub member, said bit body having fixed cutting elements secured thereto and positioned to contact an earth formation; and apparatus associated with said near-bit sub member for producing a variable depth of cut by said fixed cutting elements into said earth formation while said bit body is rotated by said drill string and wherein said apparatus is structured to provide axial movement of said bit body relative to said near-bit sub member to produce a variable depth of cut by said fixed cutting elements into said earth formation during drilling, said apparatus comprising a movable plunger attached to said bit body and a pressure relief valve for intermittently relieving pressure within said near-bit sub member.

4. An earth drilling device for variably contacting an earth formation, comprising:

a near-bit sub member configured for attachment to the downhole end of a drill string;

a bit body attached to said near-bit sub member, said bit body having fixed cutting elements secured thereto and positioned to contact an earth formation; and apparatus associated with said near-bit sub member for producing a variable depth of cut by said fixed cutting elements into said earth formation while said bit body is rotated by said drill string and wherein said apparatus is structured to provide axial movement of said bit body relative to said near-bit sub member to produce a variable depth of cut by said fixed cutting elements into said earth formation during drilling, said apparatus comprising at least one vibration mechanism positioned within said near-bit sub member to contact a movable retainer cylinder attached to said bit body.

5. An earth drilling device for variably contacting an earth formation, comprising:

a near-bit sub member configured for attachment to the downhole end of a drill string;

a bit body attached to said near-bit sub member, said bit body having fixed cutting elements secured thereto and positioned to contact an earth formation; and apparatus associated with said near-bit sub member for producing a variable depth of cut by said fixed fixed cutting elements into said earth formation during drilling wherein said apparatus is structured to provide rotational movement of said bit body within said earth formation to produce a variable depth of cut by said fixed cutting elements into said earth formation during drilling.

6. The earth drilling device of claim 5 wherein said apparatus is a hole wall brake movably secure to said near-bit sub member and positioned to variably contact said earth formation as said bit body rotates to provide rotational movement of said bit body relative to the earth formation.

7. An earth drilling device for variably contacting an earth formation, comprising:

a bit body configured for attachment to a downhole end of a drill string and comprised of a bit shank and a crown;

at least one fixed cutting element secured to said bit body and positioned to contact an earth formation, wherein said crown of said bit body is attached and movable relative to said bit shank to provide a variable depth of cut by said at least one fixed cutting element into said earth formation during drilling; and apparatus associated with said bit body for producing said variable depth of cut by said fixed cutting element into said earth formation during drilling, said apparatus including a resilient split ring positioned between said crown and said bit shank to provide axial movement of said crown relative to said bit shank.

8. An earth drilling device for variably contacting an earth formation, comprising:

a bit body configured for attachment to a downhole end of a drill string and comprised of a bit shank and a crown;

at least one fixed cutting element secured to said bit body and positioned to contact an earth formation, wherein said crown of said bit body is attached and movable relative to said bit shank to provide a variable depth of cut by said at least one fixed cutting element into said earth formation during drilling, said crown further comprising separate crown sections attached to and laterally movable relative to said bit shank; and apparatus associated with said bit body for producing said variable depth of cut by said at least one fixed cutting element into said earth formation during drilling.

9. The earth drilling device of claim 8 wherein said apparatus includes a spring-loaded fastener attaching each said separate crown section to said bit shank.

10. An earth drilling device for variably contacting an earth formation, comprising:

a bit body configured for attachment to a downhole end of a drill string and comprised of a bit shank a crown and at least one blade movably secured to said bit body;

at least one fixed cutting element secured to said bit body by said at least one blade and positioned to contact an earth formation, wherein said crown of said bit body is attached and movable relative to said bit shank to provide a variable depth of cut by said at least one fixed cutting element into said earth formation during drilling; and apparatus associated with said bit body for producing said variable depth of cut by said at least one fixed cutting element into said earth formation during drilling, said apparatus comprising a movable fastener positioned through said at least one blade and movable responsive to an increase in pressure within said bit body.

11. An earth drilling device for variably contacting an earth formation, comprising:

a bit body configured for attachment to a downhole end of a drill string and comprised of a bit shank and a crown;

at least one fixed cutting element movably secured to said bit body and positioned to contact an earth formation; and apparatus associated with said bit body for producing a variable depth of cut by said at least one fixed cutting element into said earth formation during drilling, said apparatus comprising a piston slidably movable relative to said bit body and attached to said at least one fixed cutting element.

12. A method of drilling a subterranean formation, comprising:

providing a drill bit having a plurality of fixed cutting elements therefore and a longitudinal axis;

coupling said drill bit to a drill string;

rotating said drill bit into a subterranean formation; and oscillating said drill bit relative to said subterranean formation as said drill bit rotates while engaging said subterranean formation to provide a variable depth of cut by said plurality of fixed cutting elements into said subterranean formation during drilling.

13. The method of claim 12, wherein oscillating said drill bit comprises axial oscillation of said drill bit along said longitudinal axis thereof.

14. The method of claim 13, wherein said axial oscillation is produced by resiliently biasing said drill bit relative to said drill string.

15. The method of claim 14, wherein said axial oscillation is further provided by pulsing drilling fluid through said drill string and drill bit.

16. The method of claim 13, wherein said axial oscillation is provided by creating hydrostatic pressure within said drill bit, and further providing pressure relief from said drill bit to produce oscillating movement of said drill bit.

17. The method of claim 13, wherein said axial oscillation is provided by positioning at least one electrically-driven vibrating mechanism against said drill bit.

18. The method of claim 13, wherein said axial oscillation is produced by positioning an oscillation mechanism in a pathway of fluid flowing through said drill bit to provide axial movement of said drill bit.

19. The method of claim 13, wherein said axial oscillation is provided by cyclically varying the weight on bit.

20. The method of claim 12, wherein oscillating said drill bit comprises torsional oscillation of said drill bit relative to said subterranean formation.

21. The method of claim 20, wherein said torsional oscillation is produced by pulsing drilling fluid through said drill string and said drill bit.

22. The method of claim 20, wherein said torsional oscillation is produced by rotating an unbalanced downhole motor above said drill bit.

23. The method of claim 20, wherein said torsional oscillation is produced by rotating an unbalanced near-bit sub attached to said drill bit.

24. The method of claim 20, wherein said torsional oscillation is produced by pulsing a hole wall brake into an out of engagement with a wall of the subterranean formation during drilling.

25. The method of claim 20, wherein said torsional oscillation is produced by pulsing at least one cutting element into and out of a socket formed within said drill bit.

26. The method of claim 20, wherein said torsional oscillation is produced by cyclically engaging and disengaging a slip clutch associated with said drill bit.

27. The method of claim 20, wherein said torsional oscillation is produced by pulsing drilling fluid through said drill bit to create an irregular turbulent and oscillating flow of drilling fluid around the drill bit.

28. The method of claim 12, wherein oscillating said drill bit includes vertically oscillating and torsionally oscillating said drill bit.

29. A method of forming irregularly shaped formation chips with an oscillating, rotary-type drill bit, comprising:

rotating said rotary-type drill bit into a subterranean formation to produce formation chips on fixed cutting elements carried by said rotary-type drill bit;

oscillating said rotary-type drill bit at a frequency to form elongated formation chips on cutting faces of said fixed cutting elements, said elongated formation chips having at least two thick portions longitudinally adjacent at least one thin portion.

30. The method according to claim 29 wherein said rotary-type drill bit is axially oscillated.

31. The method of claim 29, wherein said rotary-type drill bit is torsionally oscillated.

32. The method of claim 30, wherein said rotary-type drill bit is torsionally oscillated.

* * * * *